US009594338B2

(12) United States Patent
Morishita et al.

(10) Patent No.: US 9,594,338 B2
(45) Date of Patent: Mar. 14, 2017

(54) IMAGE FORMING APPARATUS WITH PHOTOSENSITIVE DRUM THAT CYCLICALLY RECIPROCATES IN AN AXIAL DIRECTION

(71) Applicant: KYOCERA Document Solutions Inc., Osaka-shi, Osaka (JP)

(72) Inventors: Hiroki Morishita, Osaka (JP); Koichi Imanaka, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/051,774

(22) Filed: Feb. 24, 2016

(65) Prior Publication Data

US 2016/0252868 A1 Sep. 1, 2016

(30) Foreign Application Priority Data

Feb. 26, 2015 (JP) ..... 2015-036085
Feb. 26, 2015 (JP) ..... 2015-036086

(51) Int. Cl.
*G03G 15/00* (2006.01)
*G03G 21/00* (2006.01)

(52) U.S. Cl.
CPC ..... *G03G 15/757* (2013.01); *G03G 21/0005* (2013.01); *G03G 21/0094* (2013.01); *G03G 15/751* (2013.01)

(58) Field of Classification Search
CPC ..... G03G 15/757; G03G 21/0005; G03G 21/0094
(Continued)

(56) References Cited

U.S. PATENT DOCUMENTS 4,425,036 A * 1/1984 Kameyama ..... G03G 15/757 355/133
5,572,293 A * 11/1996 Kikuchi ..... G03G 15/0225 361/225
(Continued)

FOREIGN PATENT DOCUMENTS

EP 2343607 A2 7/2011
JP S62116271 U 7/1987
(Continued)

OTHER PUBLICATIONS

European Search Report Dated Jun. 27, 2016.
Japanese Office Action Dated Jul. 19, 2016.

*Primary Examiner* — Sandra Brase
(74) *Attorney, Agent, or Firm* — Gerald E. Hespos; Michael J. Porco; Matthew T. Hespos

(57) ABSTRACT

An image forming apparatus includes a housing, a photosensitive drum, a cleaning member, a driving transmission portion, and a movement mechanism. The photosensitive drum is rotatably supported by the housing about a first shaft portion. The driving transmission portion transmits a rotation driving force to the photosensitive drum. The movement mechanism reciprocates the photosensitive drum in an axial direction. The movement mechanism includes a first rotation gear, a second rotation gear, a first intermediate gear, and a second intermediate gear. The first rotation gear integrally rotates with the photosensitive drum. The second rotation gear has teeth different in number from teeth of the first rotation gear and rotates with a predetermined speed difference relative to the first rotation gear. The first and second intermediate gears are a pair of rotation gears rotatable about a second shaft portion parallel to the first shaft portion.

10 Claims, 14 Drawing Sheets

(58) Field of Classification Search
USPC ..... 399/167
See application file for complete search history.

(56) References Cited

U.S. PATENT DOCUMENTS

| | | | | |
|---|---|---|---|---|
| 5,630,199 | A * | 5/1997 | To | G03G 15/0216 361/225 |
| 2006/0165451 | A1* | 7/2006 | Baek | G03G 21/105 399/350 |
| 2011/0158704 | A1 | 6/2011 | Takagi | |
| 2012/0163866 | A1 | 6/2012 | Morishita | |
| 2014/0153973 | A1 | 6/2014 | Takagi | |
| 2014/0294478 | A1 | 10/2014 | Osaki et al. | |
| 2015/0010332 | A1 | 1/2015 | Takagi et al. | |
| 2015/0338773 | A1 | 11/2015 | Takagi et al. | |

FOREIGN PATENT DOCUMENTS

| | | | |
|---|---|---|---|
| JP | 2005180625 | A | 7/2005 |
| JP | 2012-133268 | | 7/2012 |
| JP | 2015025931 | A | 2/2015 |

* cited by examiner

IMAGE FORMING APPARATUS WITH PHOTOSENSITIVE DRUM THAT CYCLICALLY RECIPROCATES IN AN AXIAL DIRECTION

INCORPORATION BY REFERENCE

This application is based on Japanese Patent Application Nos. 2015-036085 and 2015-036086 filed with Japan Patent Office on Feb. 26, 2015, the contents of which are hereby incorporated by reference.

TECHNICAL FIELD

The present disclosure relates to an image forming apparatus that forms images.

BACKGROUND ART

In a known image forming apparatus such as a copier, a printer, and a facsimile machine using an electrophotographic system, toner is supplied to an electrostatic latent image formed on an image carrier (photosensitive drum) to develop the same, whereby a toner image is formed on the image carrier. When the toner image is transferred onto a sheet and subjected to a predetermined fixing process, an image is formed on the sheet.

In addition, in a known image forming apparatus, a cleaning blade contacts a photosensitive drum to clean up toner remaining on the photosensitive drum. Moreover, in a known technology, a photosensitive drum reciprocates in its axial direction in order to prevent foreign matter caught in the tip of a cleaning blade from scratching a surface of the photosensitive drum (streak uneven abrasion).

In the technology, the photosensitive drum reciprocates with a pair of cams arranged at one end in the axial direction of the photosensitive drum. Each of the pair of cams has two convex portions and two concave portions along its circumferential direction. When the convex portions of the cams sequentially contact each other and the concave portions of the cams sequentially contact each other, the photosensitive drum makes two round trips while rotating one revolution.

SUMMARY OF INVENTION

An image forming apparatus according to an aspect of the present disclosure includes a housing, a photosensitive drum, a cleaning member, a driving transmission portion, and a movement mechanism. The photosensitive drum is rotatably supported by the housing about a first shaft portion, an electrostatic latent image being formed on a peripheral surface thereof, and a developer image being carried thereby. The cleaning member is supported by the housing, contacts the peripheral surface of the photosensitive drum, and cleans up the peripheral surface. The driving transmission portion transmits a rotation driving force about the first shaft portion to the photosensitive drum. The movement mechanism reciprocates the photosensitive drum in an axial direction of the first shaft portion at a predetermined cycle. The movement mechanism includes a first rotation gear, a second rotation gear, a first intermediate gear, and a second intermediate gear. The first rotation gear is fixed to the photosensitive drum and integrally rotates with the photosensitive drum about the first shaft portion. The second rotation gear is arranged facing the first rotation gear in the axial direction, has teeth different in number from teeth of the first rotation gear, is restricted in a position thereof in the axial direction, and rotates about the first shaft portion with a predetermined speed difference relative to the first rotation gear. The first intermediate gear and the second intermediate gear are a pair of rotation gears rotatable about a second shaft portion parallel to the first shaft portion of the photosensitive drum. The first intermediate gear engages with the first rotation gear. The second intermediate gear is arranged adjacent to the first intermediate gear in the axial direction, engages with the second rotation gear, has teeth different in number from teeth of the first intermediate gear, and integrally rotates with the first intermediate gear. The first rotation gear has a first cam surface. The first cam surface is arranged at a side surface of the first rotation gear facing the second rotation gear and has different projection amounts in the axial direction along a circumferential direction thereof. The second rotation gear has a second cam surface. The second cam surface is arranged at a side surface of the second rotation gear facing the first rotation gear, has different projection amounts in the axial direction along a circumferential direction thereof, and is capable of contacting the first cam surface. The second rotation gear rotates with the speed difference relative to the first rotation gear as a result of transmission of the rotation driving force from the first rotation gear to the second rotation gear via the first intermediate gear and the second intermediate gear when the photosensitive drum rotates with the rotation driving force, and the photosensitive drum reciprocates in the axial direction as a result of contact between the first cam surface and the second cam surface.

An image forming apparatus according to another aspect of the present disclosure includes a housing, a photosensitive drum, a cleaning member, and a movement mechanism. The photosensitive drum is rotatably supported by the housing about a shaft, an electrostatic latent image being formed on a peripheral surface thereof, and a developer image being carried thereby. The cleaning member is supported by the housing, contacts the peripheral surface of the photosensitive drum, and cleans up the peripheral surface. The movement mechanism reciprocates the photosensitive drum in an axial direction at a predetermined cycle. The movement mechanism includes a first cam member and a second cam member. The first cam member is fixed to the photosensitive drum and integrally rotates with the photosensitive drum about the shaft. The second cam member is arranged facing the first cam member in the axial direction, restricted in a position thereof in the axial direction, and rotates about the shaft with a predetermined speed difference relative to the first cam member. The first cam member includes a first convex portion and a first concave portion. The first convex portion projects at a consistent height toward the second cam member along a rotation direction and about the shaft and is spirally formed about the shaft to curve to an inside or an outside in a radial direction thereof as the first convex portion extends in the rotation direction. The first concave portion is arranged to be along the first convex portion and deeper in the axial direction than the first convex portion and spirally formed about the shaft. The second cam member includes a second convex portion and a second concave portion. The second convex portion projects at a consistent height toward the first cam member along a rotation direction about the shaft and is spirally formed about the shaft to curve to an inside or an outside in a radial direction thereof as the second convex portion extends in the rotation direction. The second concave portion is arranged to be along the second convex portion and deeper in the axial direction than the second convex portion and spirally formed about the shaft. The photosensitive drum is positioned at a first position most separated from the second cam member when the first convex portion contacts the second convex portion as a result of the rotation of the first cam member and the second cam member about the shaft. The photosensitive drum is positioned at a second position closest to the second cam member when the first convex portion fits into the second concave portion and the second convex portion fits into the first concave portion as a result of the rotation of the first cam member and the second cam member about the shaft.

DESCRIPTION OF EMBODIMENTS

Figure 1:
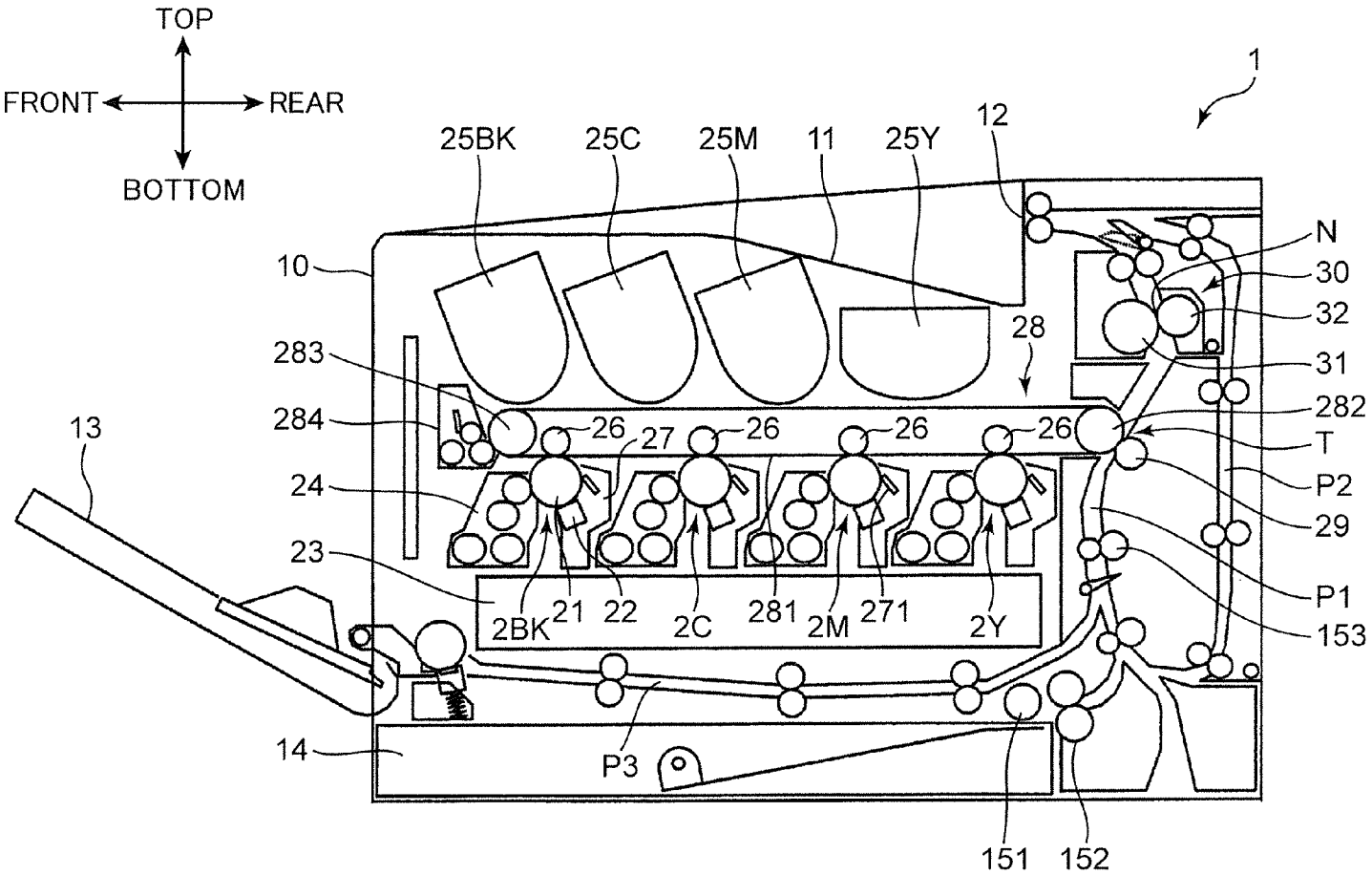
FIG. 1 is a cross-sectional view showing the schematic configuration of an image forming apparatus according to a first embodiment of the present disclosure.

Hereinafter, a description will be given in detail of a first embodiment of the present disclosure with reference to the drawings. FIG. 1 is a schematic cross-sectional view showing the inner structure of an image forming apparatus 1 according to the embodiment of the present disclosure. The image forming apparatus 1 is a tandem-type color printer and includes a substantially-rectangular main body housing 10. Note that the image forming apparatus may be a full-color or monochrome copier or complex machine.

The main body housing 10 accommodates a plurality of process units that perform an image forming process on sheets. In the embodiment, the image forming apparatus 1 has image forming units 2Y, 2C, 2M, and 2Bk, an optical scanning unit 23, an intermediate transfer unit 28, and a fixing unit 30 as the process units. The main body housing 10 has a sheet catching tray 11 at its top surface. A sheet ejection port 12 is opened facing the sheet catching tray 11. The main body housing 10 has an openable/closable manual feeding tray 13 at its side wall. The main body housing 10 has an attachable/detachable sheet feeding cassette 14, which accommodates sheets to be subjected to the image forming process, at its bottom part.

The image forming units 2Y, 2C, 2M, and 2Bk are used to form toner images of the respective colors of yellow, cyan, magenta, and black based on image information sent from external equipment such as a computer and horizontally arranged in tandem at a predetermined interval. The respective image forming units 2Y, 2C, 2M, and 2Bk have cylindrical photosensitive drums 21 that is capable of holding electrostatic latent images formed on their peripheral surfaces and carrying toner images (developer images) on them, chargers 22 that charge the peripheral surfaces of the photosensitive drums 21, development units 24 that attach developer to electrostatic latent images to form toner images, toner containers 25Y, 25C, 25M, 25Bk that supply the toner of the respective colors of yellow, cyan, magenta, and black to the development units 24, primary transfer rollers 26 that primarily transfer toner images formed on the photosensitive drums 21, and cleaning units 27 that remove toner remaining on the peripheral surfaces of the photosensitive drums 21.

The optical scanning unit 23 forms electrostatic latent images on the peripheral surfaces of the photosensitive drums 21 of the respective colors. The optical scanning unit 23 of the embodiment has a plurality of light sources for the respective colors and an image forming optical system that performs image forming and scanning on the peripheral surfaces of the photosensitive drums 21 of the respective colors with light emitted from the light sources.

The intermediate transfer unit 28 primarily transfers toner images formed on the photosensitive drums 21. The intermediate transfer unit 28 has a transfer belt 281 that circulates around while contacting the peripheral surfaces of the respective photosensitive drums 21 and a driving roller 282 and a driven roller 283 around which the transfer belt 281 is stretched. The transfer belt 281 is pressed to the peripheral surfaces of the respective photosensitive drums 21 by the primary transfer roller 26. Toner images on the photosensitive drums 21 of the respective colors are primarily transferred onto the same spot on the transfer belt 281 to overlap each other. Thus, a full-color toner image is formed on the transfer belt 281.

A secondary transfer roller 29 that forms a secondary transfer nip portion T via the transfer belt 281 is arranged facing the driving roller 282. A full-color toner image on the transfer belt 281 is secondarily transferred onto a sheet at the secondary transfer nip portion T. Toner remaining on the peripheral surface of the transfer belt 281 without being transferred onto a sheet is collected by a belt cleaning unit 284 arranged facing the driven roller 283.

The fixing unit 30 has a fixing roller 31 including a heat source and a press roller 32 that forms a fixing nip portion N with the fixing roller 31. The fixing unit 30 performs a fixing process in which a sheet having a toner image transferred at the secondary transfer nip portion T is heated and pressed at a fixing nip portion N to weld toner to the sheet. A sheet having been subjected to the fixing process is ejected onto the sheet catching tray 11 via the sheet ejection port 12.

The main body housing 10 has a sheet conveyance path for conveying sheets. The sheet conveyance path includes a main conveyance path P1 vertically extending from the vicinity of the bottom part to the vicinity of the top part of the main body housing 10 via the secondary transfer nip portion T and the fixing unit 30. The downstream end of the main conveyance path P1 is connected to the sheet ejection port 12. An inversion conveyance path P2 for conveying sheets in an inverted state at double-sided printing is extended from the most downstream end to the vicinity of the upstream end of the main conveyance path P1. In addition, a conveyance path P3 for manual feeding sheets ranging from the manual feeding tray 13 to the main conveyance path P1 is arranged over the sheet feeding cassette 14.

The sheet feeding cassette 14 has a sheet accommodation portion that accommodates a batch of sheets. In the vicinity of the upper right part of the sheet feeding cassette 14, a pickup roller 151 that separately feeds out a sheet at the outermost layer of the batch of sheets and a pair of sheet feeding rollers 152 that feeds the sheet to the upstream end of the main conveyance path P1 are provided. Sheets placed on the manual feeding tray 13 are also fed to the upstream end of the main conveyance path P1 via the conveyance path P3 for manual feeding sheets. On the upstream side of the secondary transfer nip portion T of the main conveyance path P1, a pair of registration rollers 153 that feeds sheets to the transfer nip portion at a predetermined timing is arranged.

When one-side printing (image forming) is performed on a sheet, the sheet is fed from the sheet feeding cassette 14 or the manual feeding tray 13 to the main conveyance path P1. Then, the sheet is subjected to a transfer process in which a toner image is transferred at the secondary transfer nip portion T and then subjected to a fixing process in which transferred toner is fixed onto the sheet by the fixing unit 30. After that, the sheet is ejected onto the sheet catching tray 11 via the sheet ejection port 12. On the other hand, when double-sided printing is performed on a sheet, one side of the sheet is subjected to the transfer process and the fixing process and then partially ejected onto the sheet catching tray 11 via the sheet ejection port 12. After that, the sheet is switchback-conveyed and returned to the vicinity of the upstream end of the main conveyance path P1 via the inversion conveyance path P2. Subsequently, the other side of the sheet is subjected to the transfer process and the fixing process and ejected onto the sheet catching tray 11 via the sheet ejection port 12.

Figure 2A:
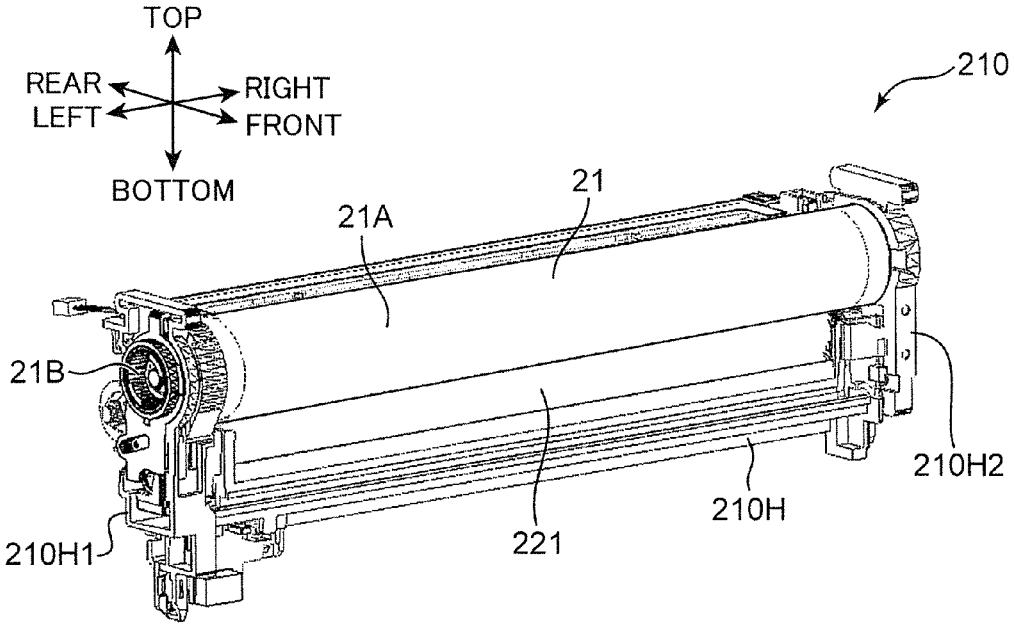
FIG. 2A is a perspective view of a drum unit according to the first embodiment of the present disclosure.
Figure 2B:
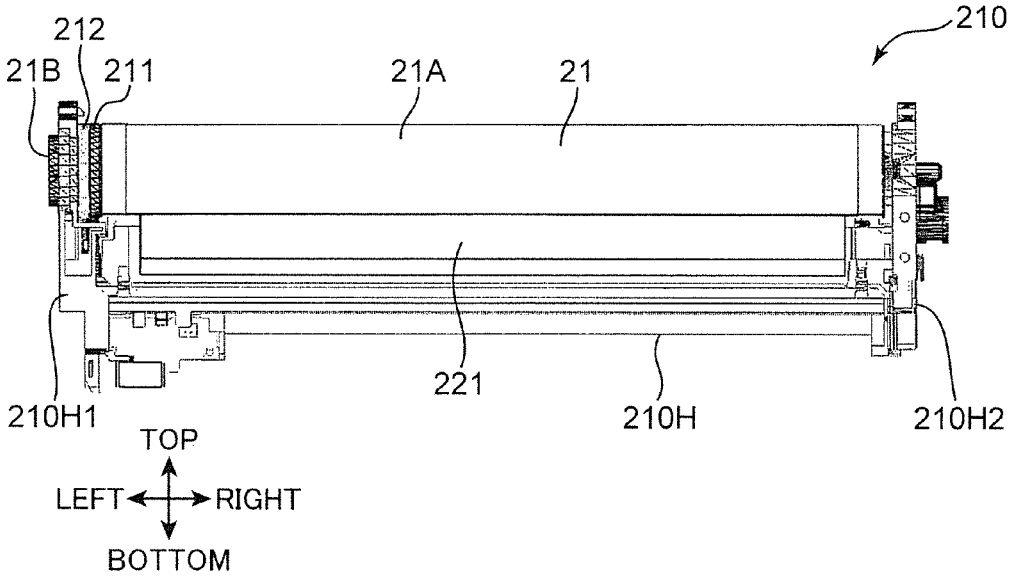
FIG. 2B is a front view of the drum unit according to the first embodiment of the present disclosure.
Figure 3:
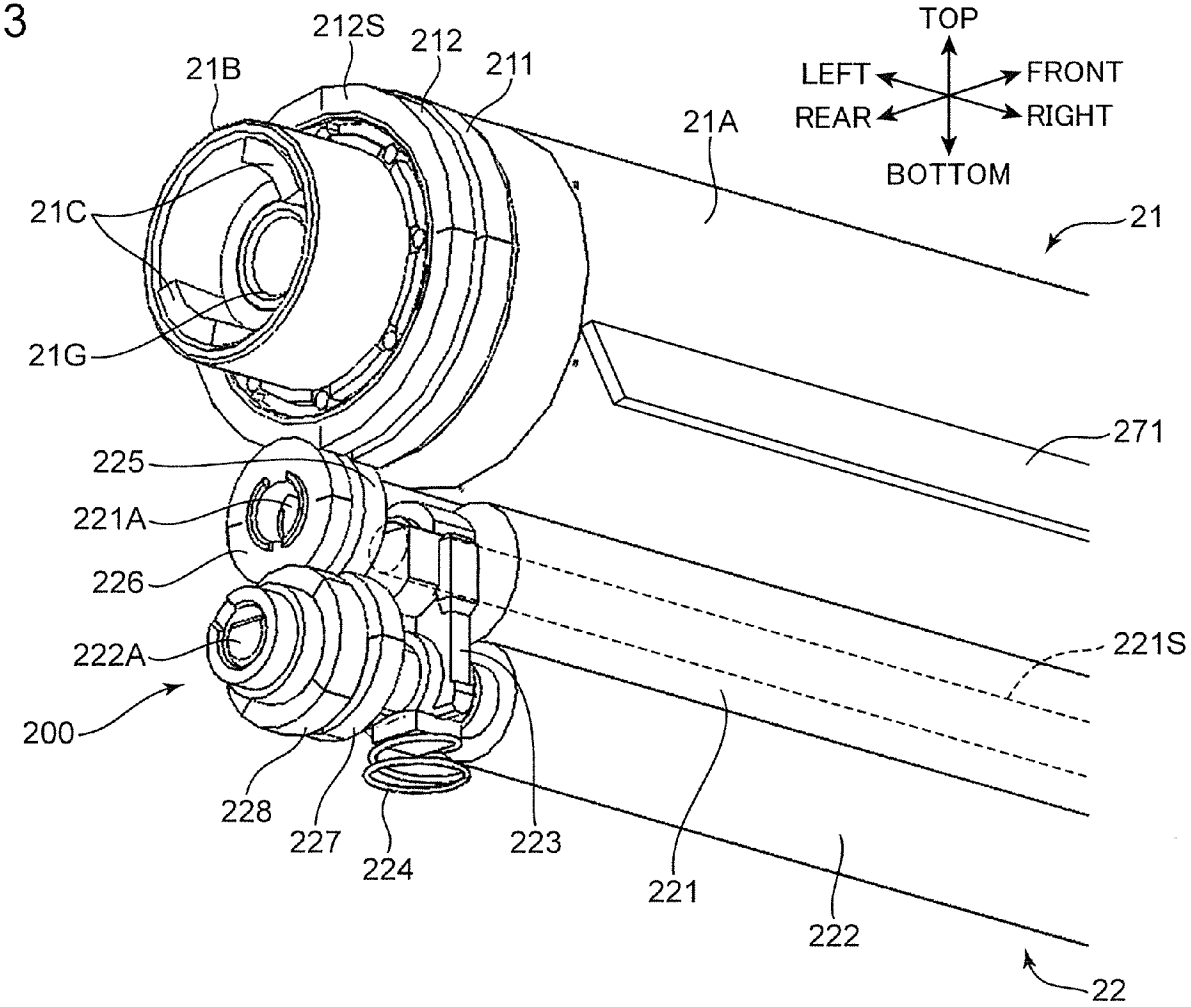
FIG. 3 is an enlarged perspective view of the inside of the drum unit according to the first embodiment of the present disclosure.

Next, a description will be given in further detail of structures around the photosensitive drums 21 of the image forming units 2Y, 2C, 2M, and 2Bk according to the embodiment with reference to FIGS. 2A to 5. FIG. 2A is a perspective view of a drum unit 210 according to the embodiment. FIG. 2B is a front view of the drum unit 210. FIG. 3 is an enlarged perspective view of the inside of the drum unit 210 according to the embodiment. Hereinafter, a description will be given of the structure of one (the image forming unit 2Y) of the image forming units 2Y, 2C, 2M, and 2Bk, but the rest units also have the same structure.

As shown in FIG. 2A, the image forming unit 2Y has the drum unit 210. The drum unit 210 has a box shape extending in a horizontal direction. The drum unit 210 is attachable/detachable to/from the main body housing 10. In the drum unit 210, the photosensitive drum 21, the charger 22, and the cleaning unit 27 described above are integrally supported. The drum unit 210 has a unit housing 210H (housing). The unit housing 210H is a housing made of a resin material and supporting the photosensitive drum 21, the charger 22, and the cleaning unit 27 described above. As shown in FIG. 2B, the drum unit 210 has a substantially U-shape in a front view. The unit housing 210H has a unit left wall 210H1 and a unit right wall 210H2. Each of the unit left wall 210H1 and the unit right wall 210H2 is a wall portion provided to stand at an end in the horizontal direction of the unit housing 210H. The unit left wall 210H1 and the unit right wall 210H2 rotatably support the photosensitive drum 21.

The photosensitive drum 21 has a drum sleeve 21A and drum flanges 21B. On the other hand, the main body housing 10 has a drum shaft 21G (first shaft portion) (FIG. 3). The drum sleeve 21A has a cylindrical shape. On the outer peripheral surface of the drum sleeve 21A, an electrostatic latent image is formed and a toner image is carried. The drum flanges 21B are members having a substantially cylindrical shape and attached at both ends in the axial direction (horizontal direction) of the drum sleeve 21A. The drum shaft 21G is a shaft extending in the horizontal direction inside the main body housing 10. When the drum unit 210 is attached to the main body housing 10, the drum shaft 21G is inserted in the drum sleeve 21A via the drum flanges 21B. As a result, the position of the rotation shaft of the photosensitive drum 21 is determined, and the photosensitive drum 21 is rotatably supported about the drum shaft 21G.

Note that the cylinder of the drum flange 21B (driving transmission portion) on a left end side among the pair of drum flanges 21B has engagement portions 21C (FIG. 3). When the drum unit 210 is attached to the main body housing 10, a coupling gear (not shown) provided on the side of the main body housing 10 engages with the engagement portions 21C of the drum flanges 21B. The coupling gear is connected to a motor (driving portion) (not shown). As a result, the rotation driving force of the motor is transmitted to the photosensitive drum 21 via the coupling gear and the engagement portions 21C to rotate the photosensitive drum 21.

The drum unit 210 also has drum bearing portions (not shown). The drum bearing portions are bearings attached to the unit left wall 210H1 and the unit right wall 210H2 of the unit housing 210H. When the drum flanges 21B of the photosensitive drum 21 are inserted in the drum bearing portions, the photosensitive drum 21 is rotatably supported by the unit housing 210H.

As shown in FIG. 3, the charger 22 described above has a charging roller 221, a brush roller 222, charging housings 223, and a roller spring 224. The charging roller 221 uniformly charges the peripheral surface of the photosensitive drum 21 at predetermined potential while rotating to follow the rotation of the photosensitive drum 21. The brush roller 222 is a roller member having a conductive brush formed in all directions about the shaft. The brush roller 222 has a brush shaft 222A (fourth shaft portion) (FIG. 3) parallel to the drum shaft 21G. The brush roller 222 rotates about the brush shaft 222A and cleans up the surface of the charging roller 221.

The pair of charging housings 223 is provided at both ends in the axial direction of the charging roller 221 and the brush roller 222. The charging housings 223 rotatably support the charging roller 221 and the brush roller 222 while maintaining a constant distance between the shafts of the charging roller 221 and the brush roller 222. The roller spring 224 is a spring member that presses the charging housing 223 to urge the charging roller 221 to the photosensitive drum 21.

In addition, the cleaning unit 27 has a cleaning blade 271 (cleaning member) (FIGS. 1 and 3). The cleaning blade 271 is a plate-shaped elastic member that is supported by the unit housing 210H and contacts the peripheral surface of the photosensitive drum 21. The cleaning blade 271 cleans up the peripheral surface of the photosensitive drum 21.

Moreover, the drum unit 210 has a movement mechanism 200 (FIG. 3). The movement mechanism 200 reciprocates the photosensitive drum 21 in the axial direction (horizontal direction) at a predetermined cycle. In addition, the movement mechanism 200 rotates the brush roller 222 and reciprocates the brush roller 222 in the axial direction at a predetermined cycle. The movement mechanism 200 has a drum driving gear 211 (first rotation gear), a drum thrust gear 212 (second rotation gear), a driving idle gear 225 (first intermediate gear), a thrust idle gear 226 (second intermediate gear), a brush driving gear 227 (third rotation gear), and a brush thrust gear 228 (fourth rotation gear).

Figure 4:
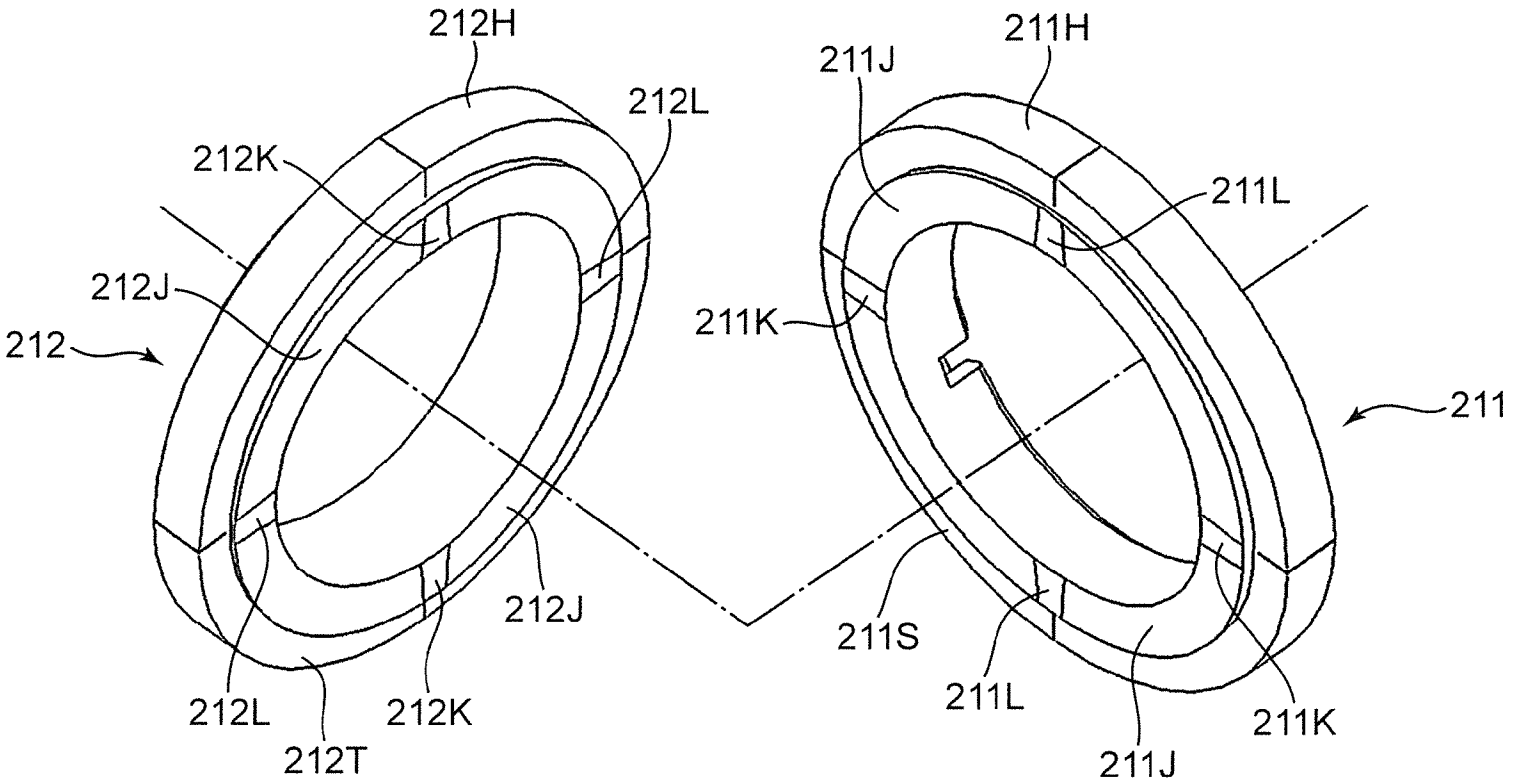
FIG. 4 is a perspective view of a first rotation gear and a second rotation gear according to the first embodiment of the present disclosure.

FIG. 4 is a perspective view of the drum driving gear 211 and the drum thrust gear 212 according to the embodiment. In FIG. 4, the respective axis lines of the drum driving gear 211 and the drum thrust gear 212 cross each other in order to show mutually-facing side surfaces (a drum driving gear left side surface 211S and a drum thrust gear right side surface 212T).

The drum driving gear 211 is a rotation gear fixed to the drum flange 21B of the photosensitive drum 21. The drum driving gear 211 has a spur gear with a predetermined number of teeth at its outer peripheral portion (driving gear outer peripheral portion 211H in FIG. 4). The drum driving gear 211 integrally rotates with the photosensitive drum 21 about the drum shaft 21G. In addition, the drum driving gear 211 has a pair of driving gear cam portions 211J (FIG. 4).

The driving gear cam portions 211J (first cam surfaces) are cam portions formed at the drum driving gear left side surface 211S facing the drum thrust gear 212. The driving gear cam portions 211J are cam surfaces having different projection amounts toward the axial direction (toward the side of the drum thrust gear 212) along their circumferential direction in the rotation of the drum driving gear 211. The pair of driving gear cam portions 211J is formed to divide the inner peripheral side portion of the drum driving gear left side surface 211 S into two in the circumferential direction. The driving gear cam portions 211J have first cam convex portions 211K and first cam concave portions 211L. The first cam convex portions 211K are portions having the highest projection height in the driving gear cam portions 211J. On the other hand, the first cam concave portions 211L are portions having the lowest projection height in the driving gear cam portions 211J. The pair of driving gear cam portions 211J has a continuous curved surface such that a movement amount (a change amount in their projection height) in the axial direction becomes constant per unit angle in the circumferential direction.

The drum thrust gear 212 is arranged facing the drum driving gear 211 in the axial direction. The drum thrust gear 212 is a rotation gear fitted onto the outer peripheral portion of the drum flange 21B. The drum thrust gear 212 has a spur gear with teeth different in number from those of the drum driving gear 211 at its outer peripheral portion (thrust gear outer peripheral portion 212H in FIG. 4). Note that a thrust gear left side surface 212S (FIG. 3) of the drum thrust gear 212 contacts the drum bearing portion fitted in the unit left wall 210H1 to restrict in advance a position (position on the side of the left end) in the axial direction of the drum thrust gear 212. Thus, the drum thrust gear 212 does not move in the axial direction and rotates about the drum shaft 21G. Note that the drum thrust gear 212 rotates with a predetermined speed difference (different rotation number) relative to the drum driving gear 211 as will be described later. The drum thrust gear 212 has a pair of thrust gear cam portions 212J (FIG. 4).

The thrust gear cam portions 212J (second cam surfaces) are cam portions formed at the thrust gear right side surface 212T facing the drum driving gear 211. The thrust gear cam portions 212J are cam surfaces having different projection amounts toward the axial direction (toward the side of the drum driving gear 211) along their circumferential direction in the rotation of the drum thrust gear 212. The pair of thrust gear cam portions 212J is formed to divide the inner peripheral side portion of the thrust gear right side surface 212T into two in the circumferential direction. The thrust gear cam portions 212J have second cam convex portions 212K and second cam concave portions 212L. The first cam convex portions 212K are portions having the greatest projection height in the thrust gear cam portions 212J. On the other hand, the second cam concave portions 212L are portions having the lowest projection height in the thrust gear cam portions 212J. The pair of thrust gear cam portions 212J also has a continuous curved surface such that a movement amount in the axial direction becomes constant per unit angle in the circumferential direction.

The driving idle gear 225 (first intermediate gear) and the thrust idle gear 226 (second intermediate gear) are a pair of rotation gears rotatable about their shaft parallel to the drum shaft 21G of the photosensitive drum 21. In the embodiment, the driving idle gear 225 and the thrust idle gear 226 rotate about an idler shaft portion 221A (FIG. 3) (second shaft portion) arranged on the same axis line as that of a rotation shaft 221S (FIG. 3) of the charging roller 221. Note that the charging roller 221 rotates to follow the rotation of the photosensitive drum 21 as described above. Thus, the charging roller 221 has the rotation shaft 221 S (third shaft portion) parallel to the drum shaft 21G. The both ends of the rotation shaft 221S is supported in the charging housings 223 (FIG. 3) and do not extend to an outside in the axial direction from the charging housings 223.

Figure 5:
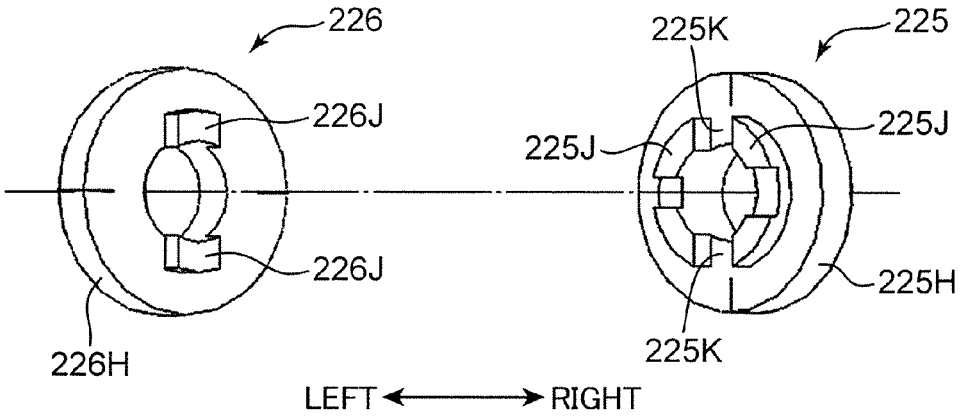
FIG. 5 is a perspective view of a first intermediate gear and a second intermediate gear according to the first embodiment of the present disclosure.

FIG. 5 is a perspective view of the driving idle gear 225 and the thrust idle gear 226 according to the embodiment. Note that the driving idle gear 225 and the thrust idle gear 226 are tilted to show their mutually-facing side surfaces in FIG. 5.

The driving idle gear 225 engages with the gear teeth of the drum driving gear 211. Thus, the driving idle gear 225 has a spur gear with a predetermined number of teeth at its outer peripheral portion 225H. The driving idle gear 225 has a pair of projection portions 225J projecting from its side surface facing the thrust idle gear 226. The pair of projection portions 225J has an arch shape and is arranged to be point-symmetrical about the rotation supporting point of the driving idle gear 225. Further, a pair of engagement concave portions 225K is formed between the pair of projection portions 225J.

The thrust idle gear 226 is arranged adjacent to the driving idle gear 225 in the axial direction. The thrust idle gear 226 engages with the gear teeth of the drum thrust gear 212. Thus, the thrust idle gear 226 has a spur gear with a predetermined number of teeth at a thrust idle gear outer peripheral portion 226H. Note that the thrust idle gear 226 has teeth different in number from those of the driving idle gear 225. The thrust idle gear 226 has a pair of engagement projection portions 226J projecting from its side surface facing the driving idle gear 225. When the engagement projection portions 226J of the thrust idle gear 226 fit into the engagement concave portions 225K of the driving idle gear 225, the driving idle gear 225 and the thrust idle gear 226 are connected to each other. As a result, the driving idle gear 225 and the thrust idle gear 226 integrally rotate about the idler shaft portion 221A.

Figure 6:
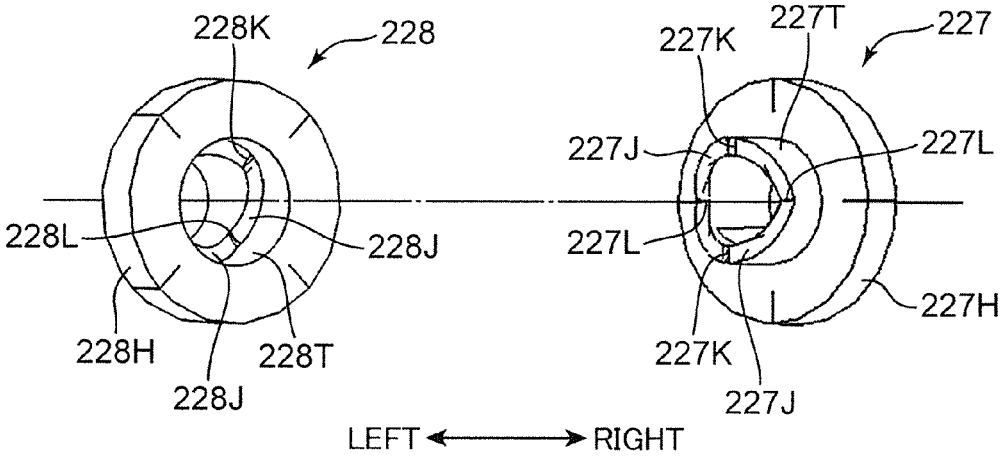
FIG. 6 is a perspective view of a third rotation gear and a fourth rotation gear according to the first embodiment of the present disclosure.

The brush driving gear 227 and the brush thrust gear 228 are a pair of rotation gears arranged on the brush shaft 222A (FIG. 3) of the brush roller 222. FIG. 6 is a perspective view of the brush driving gear 227 and the brush thrust gear 228 according to the embodiment. Note that the brush driving gear 227 and the brush thrust gear 228 are tilted to show their mutually-facing side surfaces in FIG. 6.

The brush driving gear 227 is a gear fixed to the brush shaft 222A (FIG. 3) extending to penetrate the charging housing 223 (FIG. 3) on the left side. The brush driving gear 227 integrally rotates with the brush roller 222. The brush driving gear 227 transmits a rotation driving force to the brush roller 222. The brush driving gear 227 engages with the driving idle gear 225. Thus, the brush driving gear 227 has a spur gear with a predetermined number of teeth at a brush driving gear outer peripheral portion 227H (FIG. 6). The brush driving gear 227 has a cylindrical projection portion 227T projecting from its side surface facing the brush thrust gear 228. The cylindrical projection portion 227T has a pair of brush driving gear cam portions 227J (third cam surfaces) at its tip margin.

The brush driving gear cam portions 227J are cam surfaces having different projection amounts toward the axial direction (toward the side of the brush thrust gear 228) along their circumferential direction in the rotation of the brush driving gear 227. The pair of brush driving gear cam portions 227J is formed to divide the tip end of the cylindrical projection portion 227T into two in the circumferential direction. The brush driving gear cam portions 227J have third convex portions 227K and third concave portions 227L. The third convex portions 227K are portions having the greatest projection height in the brush driving gear cam portions 227J. On the other hand, the third concave portions 227L are portions having the lowest projection height in the brush driving gear cam portions 227J. The pair of brush driving gear cam portions 227J also has a continuous curved surface such that a movement amount in the axial direction becomes constant per unit angle in the circumferential direction.

The brush thrust gear 228 is arranged adjacent to the brush driving gear 227 in the axial direction. The brush thrust gear 228 engages with the thrust idle gear 226. Thus, the brush thrust gear 228 has a spur gear with teeth different in number from those of the brush driving gear 227 at a brush thrust gear outer peripheral portion 228H (FIG. 6). The brush thrust gear 228 rotates with a speed difference (different rotation number) relative to the brush driving gear 227. Note that a position in the axial direction of the brush thrust gear 228 is restricted by the unit left wall 210H1 (FIGS. 2A and 2B) of the drum unit 210. Thus, the brush thrust gear 228 does not move in the axial direction and rotates about the brush shaft 222A.

The brush thrust gear 228 has a cylindrical inner peripheral portion 228T formed to be recessed in a cylindrical shape at its side surface facing the brush driving gear 227. The cylindrical inner peripheral portion 228T has a pair of brush thrust gear cam portions 228J (fourth cam surfaces) at its bottom.

The brush thrust gear cam portions 228J are cam surfaces having different projection amounts toward the axial direction (toward the side of the brush driving gear 227) along their circumferential direction in the rotation of the brush thrust gear 228. The pair of brush thrust gear cam portions 228J is formed to divide the bottom of the cylindrical inner peripheral portion 228T into two in the circumferential direction. The brush thrust gear cam portions 228J have fourth convex portions 228K and fourth concave portions 228L. Note that FIG. 6 shows the pair of fourth convex portion 228K and fourth concave portion 228L.

The fourth convex portions 228K are portions having the greatest projection height in the brush thrust gear cam portions 228J. On the other hand, the fourth concave portions 228L are portions having the lowest projection height in the brush thrust gear cam portions 228J. The pair of brush thrust gear cam portions 228J also has a continuous curved surface such that a movement amount in the axial direction becomes constant per unit angle in the circumferential direction.

When the photosensitive drum 21 rotates with a rotation driving force transmitted to the engagement portions 21C (FIG. 3) of the drum flange 21B, the drum driving gear 211 that integrally rotates with the photosensitive drum 21 transmits the rotation driving force to the driving idle gear 225. At this time, the thrust idle gear 226 integrally rotates with the driving idle gear 225. In addition, the driving idle gear 225 transmits the rotation driving force to the brush driving gear 227, whereby the brush roller 222 rotates about the brush shaft 222A. With the rotation of the brush roller 222, the peripheral surface of the charging roller 221 is cleaned up. Note that the charging roller 221 rotates to follow the rotation of the photosensitive drum 21 when contacting the peripheral surface of the photosensitive drum 21.

On the other hand, when the thrust idle gear 226 transmits the rotation driving force to the drum thrust gear 212, the drum thrust gear 212 rotates with a slight speed difference relative to the drum driving gear 211. In addition, when the thrust idle gear 226 transmits the rotation driving force to the brush thrust gear 228, the brush thrust gear 228 rotates with a slight speed difference relative to the brush driving gear 227.

When the drum driving gear 211 and the drum thrust gear 212 rotate with a slight speed difference between them, the driving gear cam portions 211J and the thrust gear cam portions 212J engage with each other at a predetermined cycle. As described above, the position in the axial direction of the drum thrust gear 212 is previously restricted. Thus, in the engagement between the driving gear cam portions 211J and the thrust gear cam portions 212J, the drum thrust gear 212 presses the drum driving gear 211 and the photosensitive drum 21 rightward when the first cam convex portions 211K (FIG. 4) contact the second cam convex portions 212K (FIG. 4). Note that the photosensitive drum 21 is urged leftward by a press spring (not shown) contacting the drum flange 21B on a right end side. Thus, when the first cam concave portions 211L contact the second cam concave portions 212L, the photosensitive drum 21 moves closest to the side of the drum thrust gear 212 with the urging force of the press spring. As described above, the photosensitive drum 21 cyclically reciprocates in the axial direction with the cyclic pressing force of the drum thrust gear 212 and the urging force of the press spring. In the embodiment, the photosensitive drum 21 is set to reciprocate with a stroke of 0.25 mm.

With the reciprocation of the photosensitive drum 21, a position at which the cleaning blade 271 contacts the photosensitive drum 21 moves in the axial direction. Accordingly, foreign matter and aggregate of developer (toner) held between the cleaning blade 271 and the peripheral surface of the photosensitive drum 21 is dropped off from the place between the cleaning blade 271 and the photosensitive drum 21. Thus, a scratch or uneven wearing is prevented from occurring along a circumferential direction on the peripheral surface of the photosensitive drum 21.

Similarly, when the brush driving gear cam portions 227J and the brush thrust gear cam portions 228J sequentially engage with each other (i.e., they contact each other) while the brush driving gear 227 and the brush thrust gear 228 rotate, the brush roller 222 integrally fixed to the brush driving gear 227 reciprocates in the axial direction at a predetermined cycle. Note that the brush roller 222 also has an urging spring like the photosensitive drum 21. With the reciprocation of the brush roller 222, a position at which the brush roller 222 contacts the charging roller 221 moves in the axial direction. As a result, the brush tip of the brush roller 222 is prevented from unevenly contacting the charging roller 221, and foreign matter and aggregate of developer caught in the brush tip of the brush roller 222 is dropped off from the brush of the brush roller 222. Accordingly, the surface of the charging roller 221 is stably cleaned up.

Note that the embodiment shows an example in which the drum driving gear 211 has the spur gear with 36 teeth at its outer peripheral portion and the drum thrust gear 212 has the spur gear with 33 teeth at its outer peripheral portion. In addition, the driving idle gear 225 has the spur gear with 13 teeth at its outer peripheral portion, and the thrust idle gear 226 has the spur gear with 12 teeth at its outer peripheral portion. Moreover, the brush driving gear 227 has the spur gear with 15 teeth at its outer peripheral portion, and the brush thrust gear 228 has the spur gear with 14 teeth at its outer peripheral portion. In the embodiment, the drum thrust gear 212 rotates relative to the drum driving gear 211 based on a difference in the number of the teeth between the driving idle gear 225 and the thrust idle gear 226. Further, the spur gears of the drum driving gear 211, the drum thrust gear 212, the driving idle gear 225, the thrust idle gear 226, the brush driving gear 227, and the brush thrust gear 228 are profile shifted gears such that they appropriately engage with each other based on a difference in the number of the teeth.

In the embodiment, when a printing operation is performed on an A4LEF-size sheet, the photosensitive drum 21 rotates about three revolutions to form an image on this single sheet. Further, the photosensitive drum 21 makes one round trip in the axial direction while rotating 71.5 revolutions about the drum shaft 21G. In addition, the brush roller 222 performs one round trip in the axial direction while rotating 45.5 revolutions about the brush shaft 222A. As described above, the reciprocation of the photosensitive drum 21 is carried out at a long cycle. Therefore, compared with a case in which the photosensitive drum 21 reciprocates in the axial direction at a short cycle in a printing operation, the occurrence of an image shift is prevented. That is, let it be assumed that the photosensitive drum 21 reciprocates at a short cycle at which the photosensitive drum 21 makes about one round trip while rotating 15 revolutions. In this case, when a printing operation is sequentially performed on 10 sheets, a position in the axial direction of the photosensitive drum 21 greatly differs between the first sheet and the fifth sheet. Therefore, an image shift is likely to be noticeable. Since the photosensitive drum 21 reciprocates at a long cycle as described above in the embodiment, the occurrence of such an image defect is prevented. In addition, since the image forming units 2Y, 2C, 2M, and 2Bk of the respective colors having the configuration of the drum unit 210 are mounted, the occurrence of a color shift in a color image is prevented.

In addition, when the brush roller 222 reciprocates at a short cycle, the problem of abnormal noise caused when the brush tip of the brush roller 222 and the surface of the charging roller 221 rub against each other is likely to occur. Since the brush roller 222 is also set to reciprocate at a long cycle in the embodiment, such a problem is prevented.

Note that the movement cycle of the photosensitive drum 21 that reciprocates when the driving gear cam portions 211J and the thrust gear cam portions 212J contact each other desirably differs from the movement cycle of the brush roller 222 that reciprocates when the brush driving gear cam portions 227J and the brush thrust gear cam portions 228J contact each other as described above. In this case, even when the charging roller 221 is caused to reciprocate in the axial direction by contact pressure to follow the photosensitive drum 21, the movement in the axial direction of the charging roller 221 does not synchronize with the movement in the axial direction of the brush roller 222. Accordingly, with the reciprocation of the brush roller 222, a position at which the brush roller 222 contacts the charging roller 221 may be reliably changed.

As described above, in the embodiment, the driving idle gear 225 and the thrust idle gear 226 are set to have a different number of teeth and integrally rotate. As described above, with the difference in the number of the teeth between the driving idle gear 225 and the thrust idle gear 226, the number of the rotations of the drum driving gear 211 and the drum thrust gear 212 may be made different. As a result, a cycle at which the driving gear cam portions 211J and the thrust gear cam portions 212J contact each other is set to be long, whereby the photosensitive drum 21 is allowed to reciprocate at a long cycle.

Note that unlike the driving idle gear 225 and the thrust idle gear 226 of the embodiment, it is assumed to use a single intermediate gear (idle gear) that has gear teeth long in the axial direction and engages with the drum driving gear 211 and the drum thrust gear 212 at the same time. In this case, it is assumed to decrease the modules of the teeth of the respective gears and increase the number of the teeth in order to increase the cycle of the reciprocation. In this case, however, the engagement between the respective gears becomes unstable, and there is a difficulty in accurately transmitting a driving force. On the other hand, since there is no need to decrease the modules of the driving idle gear 225 and the thrust idle gear 226 in the embodiment like this, the driving force is stably transmitted between the respective gears.

In addition, according to the embodiment, the brush roller 222 may rotate and reciprocate in the axial direction with the rotation driving force transmitted from the photosensitive drum 21. Further, based on the difference in the number of the teeth between the driving idle gear 225 and the thrust idle gear 226, the number of the rotations of the brush driving gear 227 and the brush thrust gear 228 may be made different. As a result, a cycle at which the brush driving gear cam portions 227J and the brush thrust gear cam portions 228J contact each other is set to be long, whereby the brush roller 222 is allowed to reciprocate at a long cycle.

Moreover, in the embodiment, the driving idle gear 225 and the thrust idle gear 226 may be rotatably arranged based on the shaft position of the charging roller 221. As a result, compared with a case in which the rotation shaft of the charging roller 221 and the idler shaft portion 221A are not arranged on the same axis line, the movement mechanism 200 that rotates and reciprocates the photosensitive drum 21 and the brush roller 222 is compactly arranged.

The first embodiment of the present disclosure is described above. The present disclosure is not limited to this, but the following modified embodiment may be applied.

In the embodiment, the two driving gear cam portions 211J and the two thrust gear cam portions 212J are arranged along the rotation direction. However, the present disclosure is not limited to this. A plurality of first cam convex portions 211K and a plurality of first cam concave portions 211L may be arranged at positions at which the drum driving gear 211 is evenly divided along the rotation direction. In addition, a plurality of second cam convex portions 212K and a plurality of second cam concave portions 212L may be arranged at positions at which the drum thrust gear 212 is evenly divided along the rotation direction so as to correspond in number to the first cam convex portions 211K and the first cam concave portions 211L, respectively. In this case, the number of the reciprocation times of the photosensitive drum 21 may be adjusted with the arrangement of the convex portions and the concave portions. On the other hand, a single cam portion 211J and a single thrust gear cam portion 212J may be arranged over the entire circumferential direction of the drum driving gear 211 and the drum thrust gear 212, respectively.

Figure 7A:
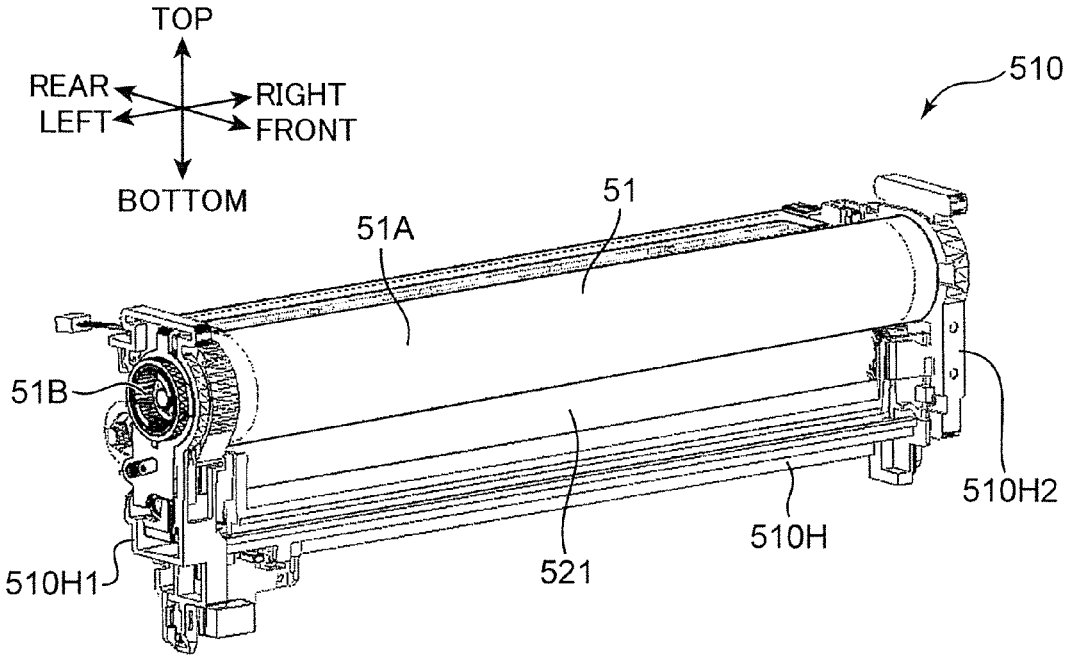
FIG. 7A is a perspective view of a drum unit according to a second embodiment of the present disclosure.
Figure 7B:
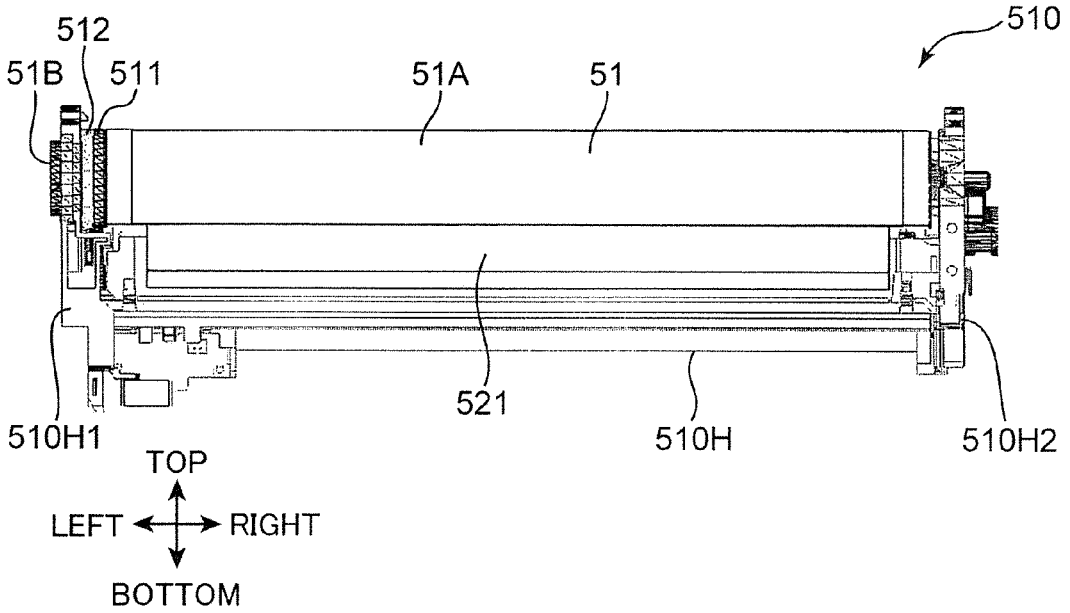
FIG. 7B is a front view of the drum unit according to the second embodiment of the present disclosure.
Figure 8:
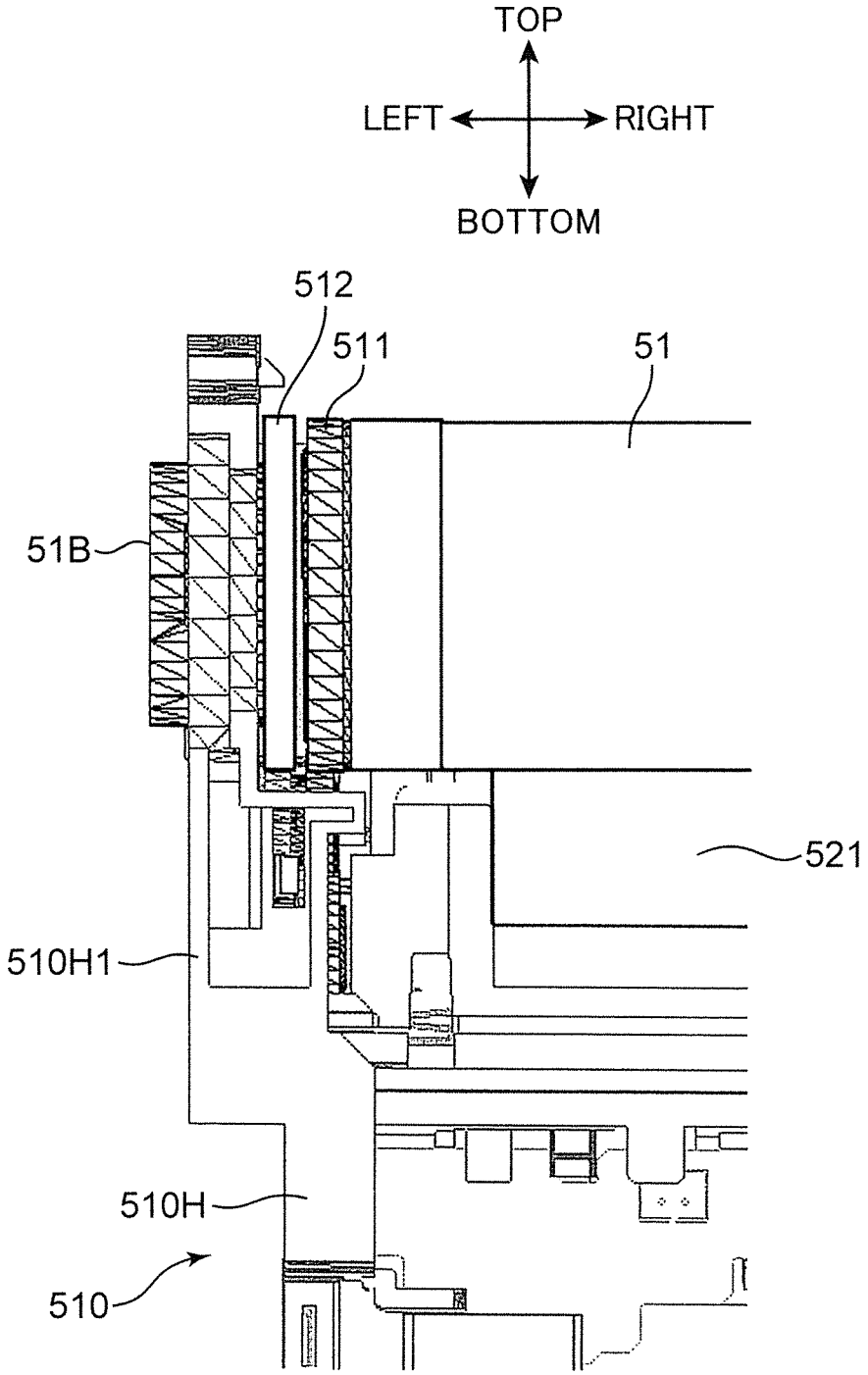
FIG. 8 is an enlarged front view of a part of the drum unit in FIG. 7B.
Figure 9:
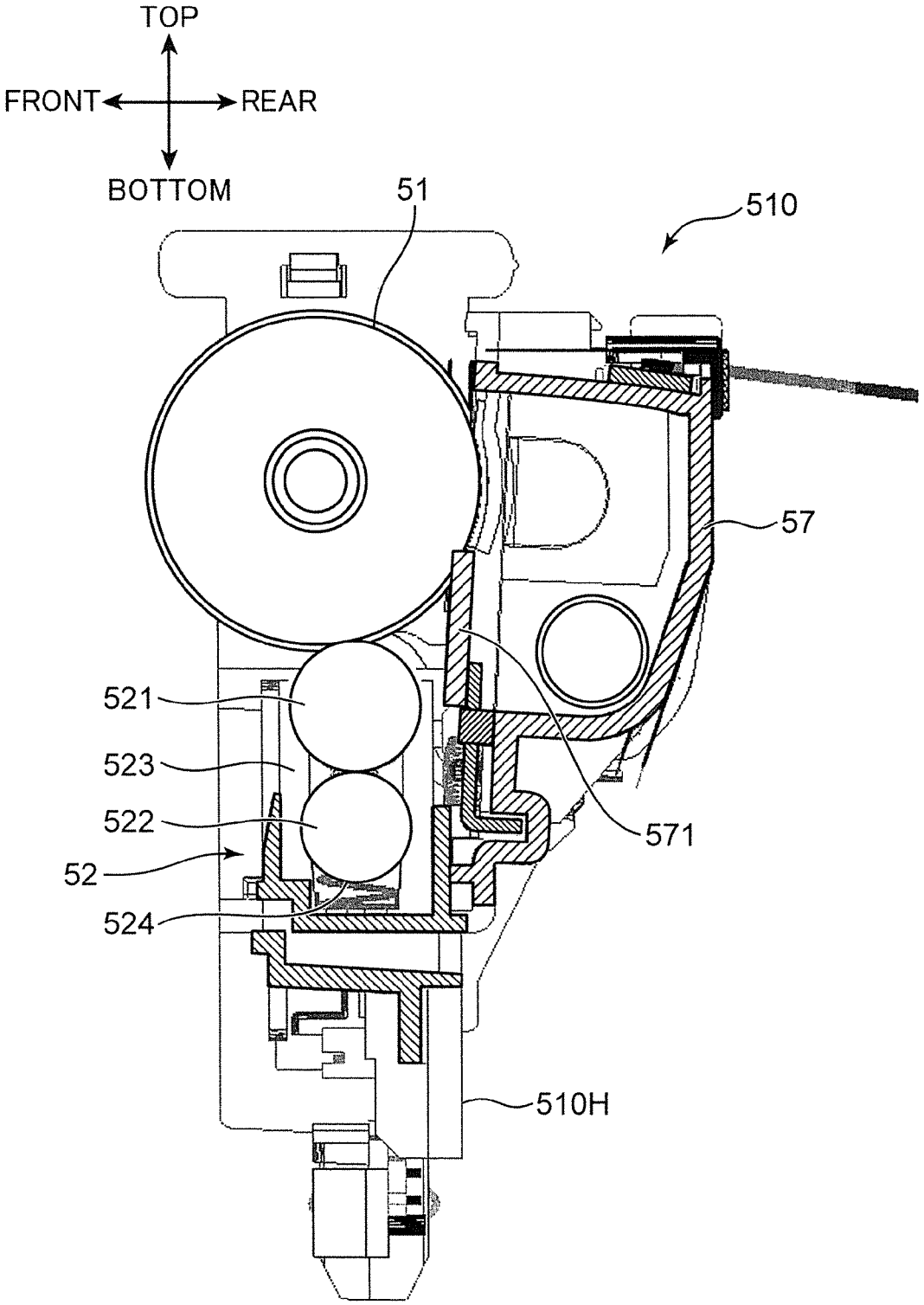
FIG. 9 is a cross-sectional view of the drum unit according to the second embodiment of the present disclosure.
Figure 10:
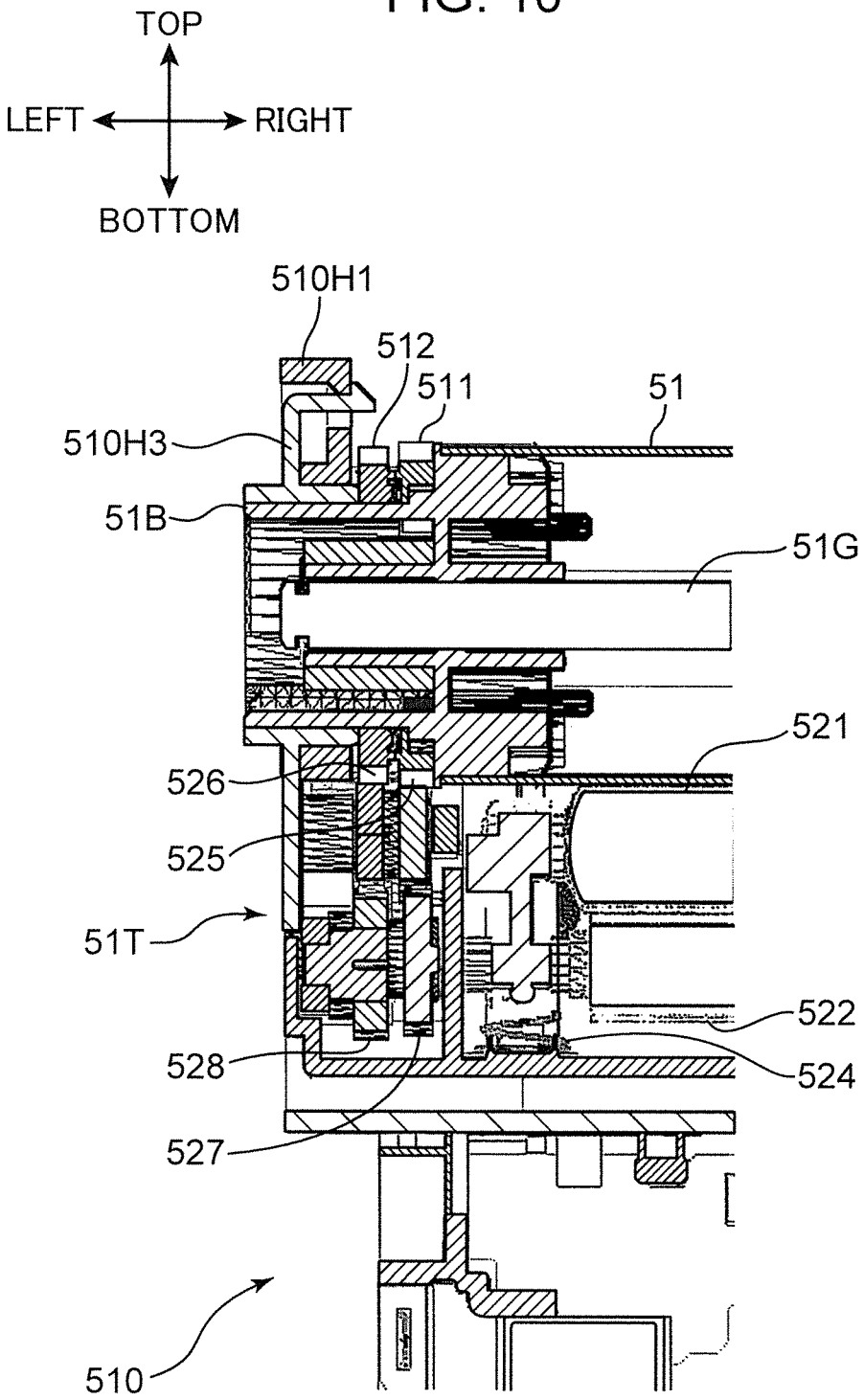
FIG. 10 is a cross-sectional view showing the state of the inside of the drum unit in FIG. 8.

Next, a description will be given of a second embodiment of the present invention with reference to FIGS. 7A to 10. In the embodiment, photosensitive drums 51 are provided instead of the photosensitive drums 21 of the foregoing first embodiment attached to the image forming units 2Y, 2C, 2M, and 2Bk in FIG. 1. Hereinafter, a description will be given in further detail of structures around the photosensitive drums 51. FIG. 7A is a perspective view of a drum unit 510 according to the embodiment. FIG. 7B is a front view of the drum unit 510. FIG. 8 is an enlarged front view of a part (left end side) of the drum unit 510 in FIG. 7B. FIG. 9 is a cross-sectional view of the drum unit 510. FIG. 10 is a cross-sectional view showing the state of the inside of the drum unit 510 in FIG. 8. Hereinafter, a description will be given of the structure of one (image forming unit 2Y) of the image forming units 2Y, 2C, 2M, and 2Bk in FIG. 1, but the rest units also have the same structure.

As shown in FIG. 7A, the image forming unit 2Y has the drum unit 510. The drum unit 510 has a box shape extending in the horizontal direction. The drum unit 510 is attachable/detachable to/from the main body housing 10 in FIG. 1. In the drum unit 510, a charger 52 and a cleaning unit 57 besides the photosensitive drum 51 described above are integrally supported (FIG. 9). The drum unit 510 has a unit housing 510H (housing). The unit housing 510H is a housing made of a resin material and supporting the photosensitive drum 51, the charger 52, and the cleaning unit 57 described above. As shown in FIG. 7B, the drum unit 510 has a substantially U-shape in a front view. The unit housing 510H has a unit left wall 510H1 and a unit right wall 510H2. Each of the unit left wall 510H1 and the unit right wall 510H2 is a wall portion provided to stand at an end in the horizontal direction of the unit housing 510H. The unit left wall 510H1 and the unit right wall 510H2 rotatably support the photosensitive drum 51.

The photosensitive drum 51 has a drum sleeve 51A and drum flanges 51B. On the other hand, in the embodiment, the main body housing 10 has a drum shaft 51G (shaft) (FIG. 10). The drum sleeve 51A has a cylindrical shape. On the outer peripheral surface of the drum sleeve 51A, an electrostatic latent image is formed and a toner image is carried. The drum flanges 51B are members having a substantially cylindrical shape and attached at both ends in the axial direction (horizontal direction) of the drum sleeve 51A. The drum shaft 51G is a shaft extending in the horizontal direction inside the main body housing 10. When the drum unit 510 is attached to the main body housing 10, the drum shaft 51G is inserted in the drum sleeve 51A via the drum flanges 51B. As a result, the position of the rotation shaft of the photosensitive drum 51 is determined.

Note that the cylinder of the drum flange 51B (driving transmission portion) on a left end side among the pair of the drum flanges 51B has engagement portions (not shown in figures). When the drum unit 510 is attached to the main body housing 10, a coupling gear (not shown) provided in the main body housing 10 engages with the engagement portions of the drum flange 51B. The coupling gear is connected to a motor (driving portion) (not shown). As a result, the rotation driving force of the motor is transmitted to the photosensitive drum 51 via the coupling gear and the engagement portions to rotate the photosensitive drum 51 about the drum shaft 51G.

The drum unit 510 also has a drum bearing 510H3 (FIG. 10). The drum bearing 510H3 is a bearing attached to the unit left wall 510H1 of the unit housing 510H. When the drum flange 51B of the photosensitive drum 51 is inserted in the drum bearing 510H3, the photosensitive drum 51 is rotatably supported about the drum shaft 51G by the unit housing 510H. Note that the photosensitive drum 51 has the same bearing as the drum bearing 510H3 on its right end side.

As shown in FIG. 9, the charger 52 described above has a charging roller 521, a brush roller 522, charging housings 523, and a roller spring 524. The charging roller 521 uniformly charges the peripheral surface of the photosensitive drum 51 at predetermined potential while rotating to follow the rotation of the photosensitive drum 51. The brush roller 522 is a roller member having a conductive brush formed in all directions about the shaft. The brush roller 522 rotates and cleans up the surface of the charging roller 521. The pair of charging housings 523 is provided at both ends in the axial direction of the charging roller 521 and the brush roller 522. The charging housings 523 rotatably support the charging roller 521 and the brush roller 522 while maintaining a constant distance between the shafts of the charging roller 521 and the brush roller 522. The roller spring 524 is a spring member that presses the charging housing 523 to urge the charging roller 521 to the photosensitive drum 51.

In addition, the cleaning unit 57 has a cleaning blade 571 (cleaning member). The cleaning blade 571 is a plate-shaped elastic member that is supported by the unit housing 510H and contacts the peripheral surface of the photosensitive drum 51. The cleaning blade 571 cleans up the peripheral surface of the photosensitive drum 51.

Moreover, the drum unit 510 has a movement mechanism 51T (FIG. 10). The movement mechanism 51T reciprocates the photosensitive drum 51 in the axial direction (horizontal direction) at a predetermined cycle. In addition, the movement mechanism 51T rotates the brush roller 522 and reciprocates the brush roller 522 in the axial direction at a predetermined cycle. The movement mechanism 51T has a drum driving gear 511 (first cam member), a drum thrust gear 512 (second cam member), a driving idle gear 525, a thrust idle gear 526, a brush driving gear 527, and a brush thrust gear 528.

The drum driving gear 511 is a rotation gear fixed to the drum flange 51B of the photosensitive drum 51. The drum driving gear 511 has a spur gear with a predetermined number of teeth at its outer peripheral portion (driving gear outer peripheral portion 511H in FIG. 11). The drum driving gear 511 integrally rotates with the photosensitive drum 51 about the drum shaft 51G. In addition, the drum driving gear 511 has driving gear cam portions 511J that will be described later. The driving gear cam portions 511J are cam portions formed facing the drum thrust gear 512.

The drum thrust gear 512 is arranged facing the drum driving gear 511 in the axial direction. The drum thrust gear 512 is a rotation gear fitted onto the outer peripheral portion of the drum flange 51B. The drum thrust gear 512 has a spur gear with teeth different in number from those of the drum driving gear 511 at its outer peripheral portion (thrust gear outer peripheral portion 512H in FIG. 11). Note that a position in the axial direction (position on the left end side) of the drum thrust gear 512 is restricted by a drum bearing 510H3. Thus, the drum thrust gear 512 does not move in the axial direction and rotates about the drum shaft 51G. Note that the drum thrust gear 512 rotates with a predetermined speed difference (different rotation number) relative to the drum driving gear 511 as will be described later. In addition, the drum thrust gear 512 has thrust gear cam portions 512J that will be described later. The thrust gear cam portions 512J are cam portions formed facing the drum driving gear 511.

The driving idle gear 525 (third intermediate gear) and the thrust idle gear 526 (fourth intermediate gear) are a pair of rotation gears rotatable about a shaft parallel to the drum shaft 51G of the photosensitive drum 51. In the embodiment, the rotation shaft of the driving idle gear 525 and the thrust idle gear 526 is arranged on the same axis line as the rotation shaft 221S (FIG. 3) of the charging roller 521. The driving idle gear 525 engages with the gear teeth of the drum driving gear 511.

The thrust idle gear 526 is arranged adjacent to the driving idle gear 525 in the axial direction. The thrust idle gear 526 engages with the gear teeth of the drum thrust gear 512. In addition, the thrust idle gear 526 has teeth different in number from those of the driving idle gear 525. The driving idle gear 525 and the thrust idle gear 526 are connected to each other by an engagement claw (not shown). Thus, the driving idle gear 525 and the thrust idle gear 526 integrally rotate about the shaft.

The brush driving gear 527 and the brush thrust gear 528 are a pair of rotation gears arranged on the rotation shaft of the brush roller 522 parallel to the drum shaft 51G. The brush driving gear 527 is integrated with the brush roller 522 and transmits a rotation driving force to the brush roller 522. The brush driving gear 527 engages with the driving idle gear 525. The brush thrust gear 528 is arranged adjacent to the brush driving gear 527 in the axial direction. The brush thrust gear 528 engages with the thrust idle gear 526. The brush thrust gear 528 has gear teeth different in number from those of the brush driving gear 527 and rotates with a speed difference (different rotation number) relative to the brush driving gear 527. The brush driving gear 527 has cam surfaces having different distances in the axial direction along its rotation direction to face the brush thrust gear 528. In addition, the brush thrust gear 528 has a cam follower capable of contacting the cam surfaces of the brush driving gear 527.

When the photosensitive drum 51 rotates with a rotation driving force transmitted to the drum flange 51B (FIG. 10), the drum driving gear 511 that integrally rotates with the photosensitive drum 51 transmits the rotation driving force to the driving idle gear 525. At this time, the thrust idle gear 526 integrally rotates with the driving idle gear 525. In addition, the driving idle gear 525 transmits the rotation driving force to the brush driving gear 527, whereby the brush roller 522 rotates about the shaft. With the rotation of the brush roller 522, the peripheral surface of the charging roller 521 is cleaned up. Note that the charging roller 521 rotates to follow the rotation of the photosensitive drum 51 when contacting the peripheral surface of the photosensitive drum 51.

On the other hand, the drum thrust gear 512 to which the rotation driving force is transmitted from the thrust idle gear 526 rotates with a slight speed difference relative to the drum driving gear 511. In addition, the brush thrust gear 528 to which the rotation driving force is transmitted from the thrust idle gear 526 rotates with a slight speed difference relative to the brush driving gear 527.

When the drum driving gear 511 and the drum thrust gear 512 rotate with a slight speed difference between them, the driving gear cam portions 511J and the thrust gear cam portions 512J engage with each other at a predetermined cycle. As described above, the position in the axial direction of the drum thrust gear 512 is restricted. Thus, the drum thrust gear 512 presses the drum driving gear 511 rightward at a predetermined cycle when the driving gear cam portions 511J and the thrust gear cam portions 512J engage with each other. Note that the photosensitive drum 51 is urged leftward by a press spring (not shown) contacting the drum flange 51B on a right end side. The photosensitive drum 51 reciprocates in the axial direction with the cyclic pressing force of the drum thrust gear 512 and the urging force of the press spring.

With the reciprocation of the photosensitive drum 51, a position at which the cleaning blade 571 contacts the photosensitive drum 51 moves in the axial direction. Accordingly, foreign matter and aggregate of developer (toner) held between the cleaning blade 571 and the peripheral surface of the photosensitive drum 51 is dropped off from the place between the cleaning blade 571 and the photosensitive drum 51. Thus, a scratch or uneven wearing is prevented from occurring along a circumferential direction on the peripheral surface of the photosensitive drum 51.

Similarly, when the brush driving gear 527 and the brush thrust gear 528 rotate with the cam surfaces and the cam follower engaging with each other (i.e., with the cam surfaces and the cam follower contacting each other), the brush roller 522 integrally fixed to the brush driving gear 527 reciprocates in the axial direction at a predetermined cycle. Thus, a position at which the brush roller 522 contacts the charging roller 521 moves in the axial direction. As a result, the brush tip of the brush roller 522 is prevented from unevenly contacting the charging roller 521, and foreign matter and aggregate of developer caught in the brush tip of the brush roller 522 is dropped off from the brush of the brush roller 522. Accordingly, the surface of the charging roller 521 is stably cleaned up.

Note that the embodiment shows an example in which the drum driving gear 511 has the spur gear with 36 teeth at its outer peripheral portion and the drum thrust gear 512 has the spur gear with 33 teeth at its outer peripheral portion. In addition, the driving idle gear 525 has the spur gear with 13 teeth at its outer peripheral portion, and the thrust idle gear 526 has the spur gear with 12 teeth at its outer peripheral portion. Moreover, the brush driving gear 527 has the spur gear with 15 teeth at its outer peripheral portion, and the brush thrust gear 528 has the spur gear with 14 teeth at its outer peripheral portion. In the embodiment, the drum thrust gear 512 rotates relative to the drum driving gear 511 based on a difference in the number of the teeth between the driving idle gear 525 and the thrust idle gear 526. As a result, the reciprocation of the photosensitive drum 51 is stably carried out. Further, the spur gears of the drum driving gear 511, the drum thrust gear 512, the driving idle gear 525, the thrust idle gear 526, the brush driving gear 527, and the brush thrust gear 528 are profile shifted gears such that they appropriately engage with each other based on a difference in the number of the teeth.

The photosensitive drum 51 makes one round trip in the axial direction while rotating 71.5 revolutions about the drum shaft 51G. In addition, the brush roller 522 makes one round trip in the axial direction while rotating 45.5 revolutions about the shaft. As described above, the reciprocation of the photosensitive drum 51 is carried out at a long cycle. Therefore, compared with a case in which the photosensitive drum 51 reciprocates at a short cycle in a printing operation, the occurrence of an image shift is prevented. That is, let it be assumed that the photosensitive drum 51 reciprocates at a short cycle at which the photosensitive drum 51 makes about one round trip while rotating 15 revolutions. In this case, when a printing operation is sequentially performed on 10 sheets, a position in the axial direction of the photosensitive drum 51 greatly differs between the first sheet and the fifth sheet. Therefore, an image shift is likely to be noticeable. Since the photosensitive drum 51 reciprocates at a long cycle as described above, the occurrence of such an image defect is prevented.

On the other hand, when the cam members of the drum driving gear 511 and the drum thrust gear 512 are in point-contact with each other, the photosensitive drum 51 is likely to discontinuously and suddenly move in the axial direction particularly with the falling of the drum thrust gear 512 (as the drum thrust gear 512 tilts in the axial direction). As a result, a sudden image shift may occur. In the embodiment, the drum driving gear 511 and the drum thrust gear 512 have the driving gear cam portions 511J and the thrust gear cam portions 512J described above, respectively, in order to solve such a problem.

Figure 11:
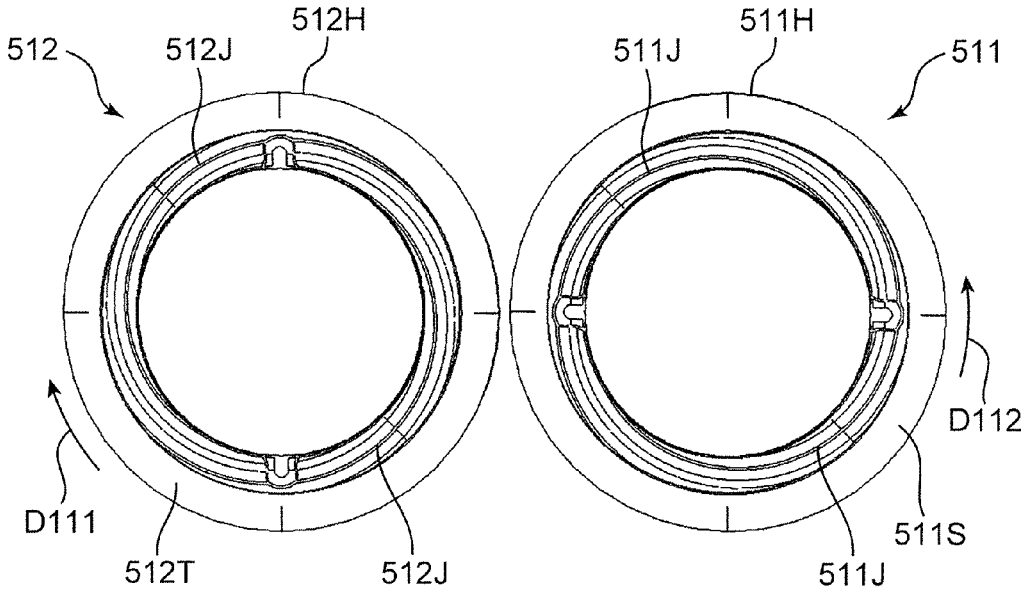
FIG. 11 is a side view of a first cam member and a second cam member according to the second embodiment of the present disclosure.
Figure 12A:
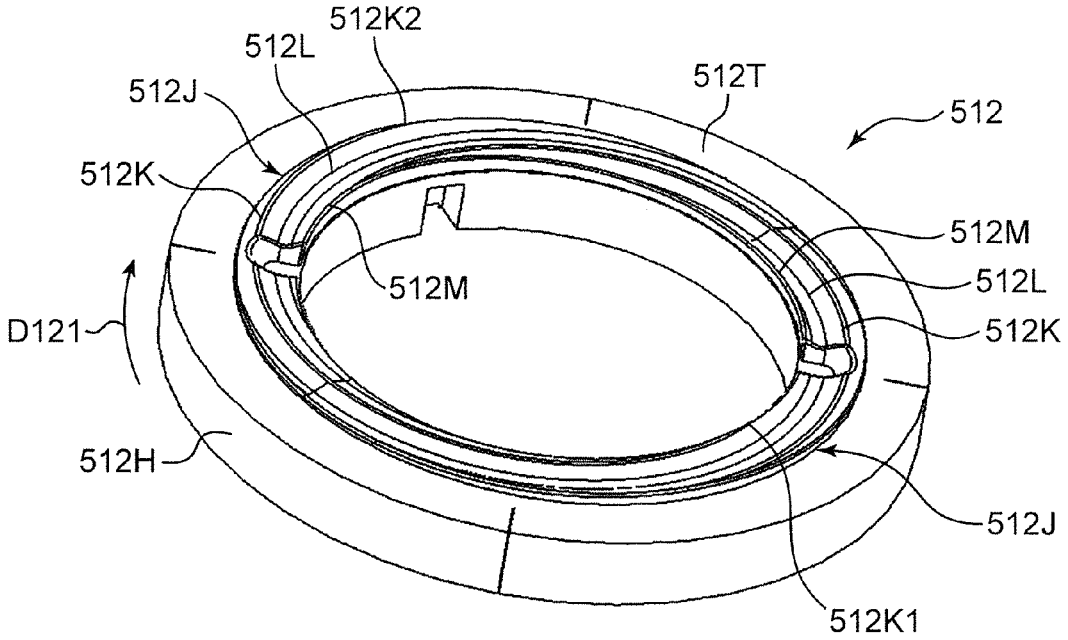
FIG. 12A is a perspective view of the second cam member according to the second embodiment of the present disclosure.
Figure 12B:
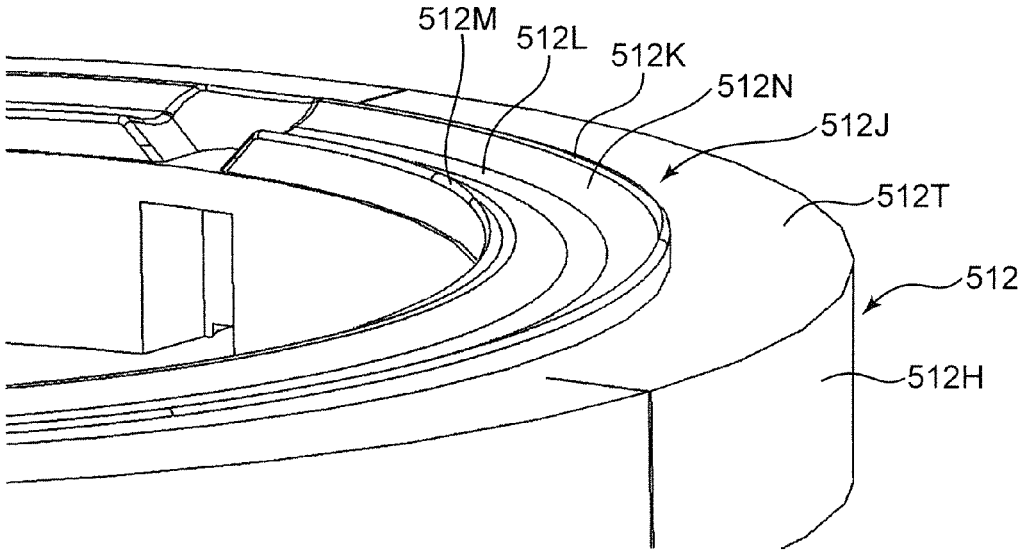
FIG. 12B is an enlarged perspective view of a part of the second cam member in FIG. 12A.

FIG. 11 is a side view of the drum driving gear 511 and the drum thrust gear 512 according to the embodiment. Note that in the side view of FIG. 11, the drum driving gear 511 is seen from its left side and the drum thrust gear 512 is seen from its right side. That is, in FIG. 11, the mutually-facing surfaces of the drum driving gear 511 and the drum thrust gear 512 (a driving gear left side surface 511S of the drum driving gear 511 and a thrust gear right side surface 512T of the drum thrust gear 512) are shown facing upward in the figure. FIG. 12A is a perspective view of the drum thrust gear 512 according to the embodiment. FIG. 12B is an enlarged perspective view of a part of the drum thrust gear 512 in FIG. 12A.

The outer peripheral portion 511H of the drum driving gear 511 and the thrust gear outer peripheral portion 512H of the drum thrust gear 512, each of which has a substantially ring shape, have gear teeth (not shown) different in number from each other. The drum driving gear 511 has the pair of driving gear cam portions 511J on the inner periphery side of the driving gear left side surface 511S. Similarly, the drum thrust gear 512 also has the pair of thrust gear cam portions 512J on the inner periphery side of the thrust gear right side surface 512T.

Figure 13A:
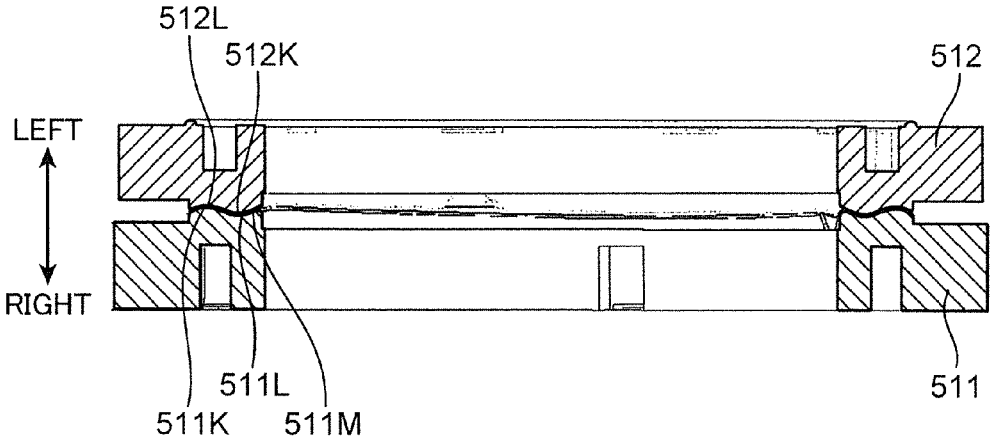
FIG. 13A is a cross-sectional view showing the state of the engagement between the first cam member and the second cam member according to the second embodiment of the present disclosure.

A description will be given in further detail of the shape of the thrust gear cam portions 512J of the drum thrust gear 512 with reference to FIGS. 12A and 12B. The pair of thrust gear cam portions 512J is formed to divide the inner peripheral side portion of the thrust gear right side surface 512T into two in the circumferential direction. The thrust gear cam portions 512J have second cam convex portions 512K (second convex portions), second cam concave portions 512L (second concave portions), and second inner-side convex portions 512M (second auxiliary convex portions). Note that the driving gear cam portions 511J of the drum driving gear 511 have the same shape as that of the thrust gear cam portions 512J. That is, the pair of driving gear cam portions 511J is formed to divide the inner peripheral side portion of the driving gear left side surface 511S into two in the circumferential direction. The driving gear cam portions 511J have first cam convex portions 511K (first convex portions) (FIG. 13A), first cam concave portions 511L (first concave portions) (FIG. 13A), and first inner-side convex portions 511M (first auxiliary convex portions) (FIG. 13A). Hereinafter, a description will be given in detail of the shapes of these cam portions using the thrust gear cam portions 512J as an example.

The second cam convex portions 512K project at the consistent height toward the drum driving gear 511 and along the rotation direction (indicated by arrow D111 in FIG. 11 and arrow D121 in FIG. 12A) about the drum shaft 51G (FIG. 9) of the drum thrust gear 512. That is, surfaces including the ridge lines of the second cam convex portions 512K extending in the rotation direction are surfaces parallel to the thrust gear right side surface 512T. Further, the second cam convex portions 512K are spirally formed about the shaft such that the second cam convex portions 512K curve toward an outside in a radial direction as they extend in the rotation direction of the drum thrust gear 512. In other words, the ridge lines of the second cam convex portions 512K move in the radial direction as the drum thrust gear 512 rotates. In FIG. 12A, one of the second cam convex portions 512K of the pair of thrust gear cam portions 512J starts at a convex-portion start point 512K1 and extends up to a convex-portion end point 512K2.

The second cam concave portions 512L are arranged to be along the second cam convex portions 512K and deeper in the axial direction than the second cam convex portions 512K and spirally formed about the shaft. As shown in FIG. 12B, the second cam convex portions 512K and the second cam concave portions 512L adjacent to each other in the radial direction are continuously connected to each other by cam slant surfaces 512N. Note that each of the second cam convex portions 512K and the second cam concave portions 512L has an arc shape with a predetermined curvature when seen in a cross section crossing the rotation direction (see FIG. 13A).

The second inner-side convex portions 512M are arranged to sandwich the second cam concave portions 512L with the second cam convex portions 512K in the radial direction and spirally formed about the shaft. The second inner-side convex portions 512M are convex portions extending parallel to the second cam convex portions 512K on the inside in the radial direction of the second cam convex portions 512K.

Note that like the second cam convex portions 512K, the first cam convex portions 511K on the side of the drum driving gear 511 (FIG. 13A) also project at the consistent height toward the drum thrust gear 512 and along the rotation direction (indicated by arrow D112 in FIG. 11) about the drum shaft 51G (FIG. 9) of the drum driving gear 511. That is, surfaces including the ridge lines of the first cam convex portions 511K extending in the rotation direction are surfaces parallel to the driving gear left side surface 511S. Further, the first cam convex portions 511K are spirally formed about the shaft such that the first cam convex portions 511K curve toward the outside in the radial direction as they extend in the rotation direction of the drum driving gear 511.

In addition, the first cam concave portions 511L (FIG. 13A) are arranged to be along the first cam convex portions 511K and deeper in the axial direction than the first cam convex portions 511K and spirally formed about the shaft. Note that each of the first cam convex portions 511K and the first cam concave portions 511L also has an arc shape with a predetermined curvature when seen in a cross section crossing the rotation direction (see FIG. 13A).

Moreover, the first inner-side convex portions 511M (FIG. 13A) are arranged to sandwich the first cam concave portions 511L with the first cam convex portions 511K in the radial direction and spirally formed about the shaft. The first inner-side convex portions 511M are convex portions extending parallel to the first cam convex portions 511K on the inside in the radial direction of the first cam convex portions 511K.

Figure 13B:
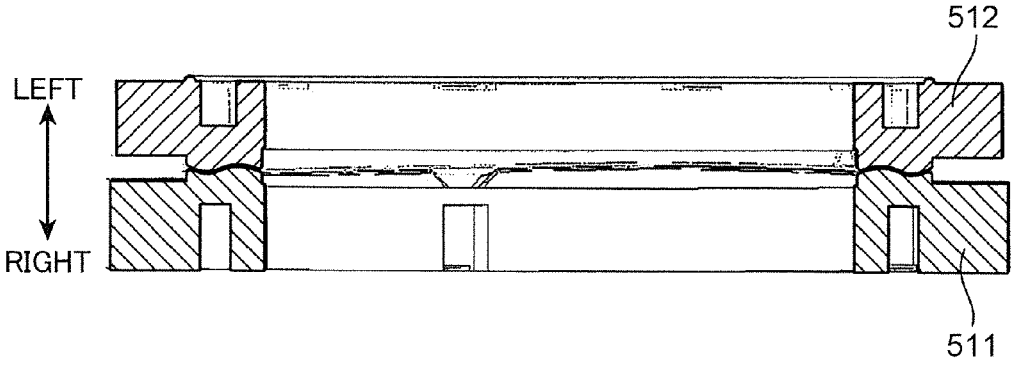
FIG. 13B is a cross-sectional view showing the state of the engagement between the first cam member and the second cam member according to the second embodiment of the present disclosure.
Figure 14A:
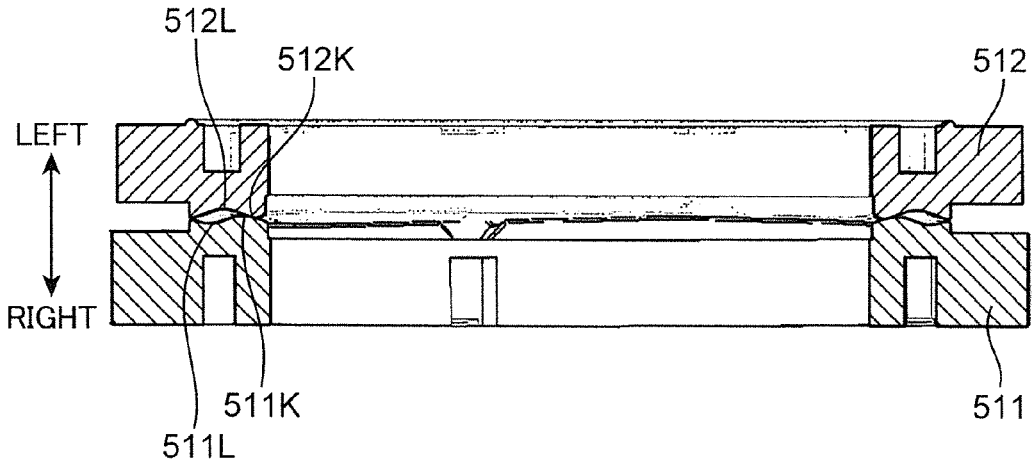
FIG. 14A is a cross-sectional view showing the state of the engagement between the first cam member and the second cam member according to the second embodiment of the present disclosure.
Figure 14B:
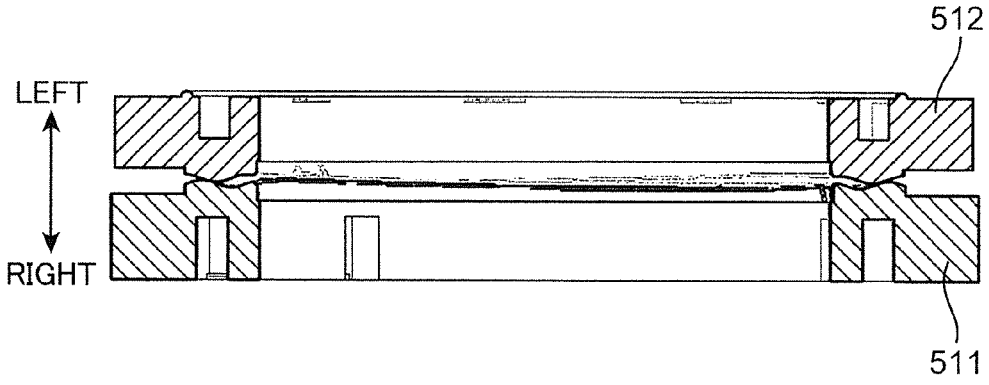
FIG. 14B is a cross-sectional view showing the state of the engagement between the first cam member and the second cam member according to the second embodiment of the present disclosure.

Next, a description will be given of the reciprocation of the photosensitive drum 51 with the rotation of the drum driving gear 511 and the drum thrust gear 512. FIGS. 13A to 15B are cross-sectional views showing the state of the engagement between the drum driving gear 511 and the drum thrust gear 512 according to the embodiment. Each of the figures corresponds to a cross-sectional view of the drum driving gear 511 and the drum thrust gear 512 seen in a cross section crossing the rotation direction, i.e., in a cross section including the axis line of each of the gears. FIGS. 13A and 13B are views in which the same engagement state is seen at different positions in the rotation direction. Similarly, FIGS. 14A and 14B are views in which the same engagement state is seen at different positions in the rotation direction. In addition, FIGS. 15A and 15B are views in which the same engagement state is seen at different positions in the rotation direction.

In FIGS. 13A and 13B, the first cam convex portions 511K and the second cam convex portions 512K fit into the second cam concave portions 512L and the first cam concave portions 511L, respectively, as the drum driving gear 511 and the drum thrust gear 512 rotate. As a result, the photosensitive drum 51 fixed to the drum driving gear 511 is arranged at a position (second position) closest to the drum thrust gear 512 in the axial direction. In the embodiment, the driving gear cam portions 511J and the thrust gear cam portions 512J are spirally formed. Therefore, as shown in FIGS. 13A and 13B, the drum driving gear 511 and the drum thrust gear 512 are kept in contact with each other even at different positions in the rotation direction (circumferential direction). In other words, the convex portions and concave portions of the drum driving gear 511 and the drum thrust gear 512 continuously contact each other along the rotation direction. Thus, compared with a case in which the convex portions and the concave portions are in point-contact with each other, the falling (tilting in the axial direction) of the drum driving gear 511 and the drum thrust gear 512 is prevented.

FIGS. 14A and 14B show states in which the drum driving gear 511 and the drum thrust gear 512 rotate by a predetermined angle from the states shown in FIGS. 13A and 13B. Due to a relative speed difference between the drum driving gear 511 and the drum thrust gear 512, a position at which the cam portions of the drum driving gear 511 and the drum thrust gear 512 contact each other shifts and the slant surface portions of the drum driving gear 511 and the drum thrust gear 512 (see the cam slant surfaces 512N in FIG. 12B) contact each other. Even in this case, the drum driving gear 511 and the drum thrust gear 512 are kept in contact with each other at different positions in the rotation direction (circumferential direction) as shown in FIGS. 14A and 14B. In other words, the slant surface portions continuously contact each other along the rotation direction.

Figure 15A:
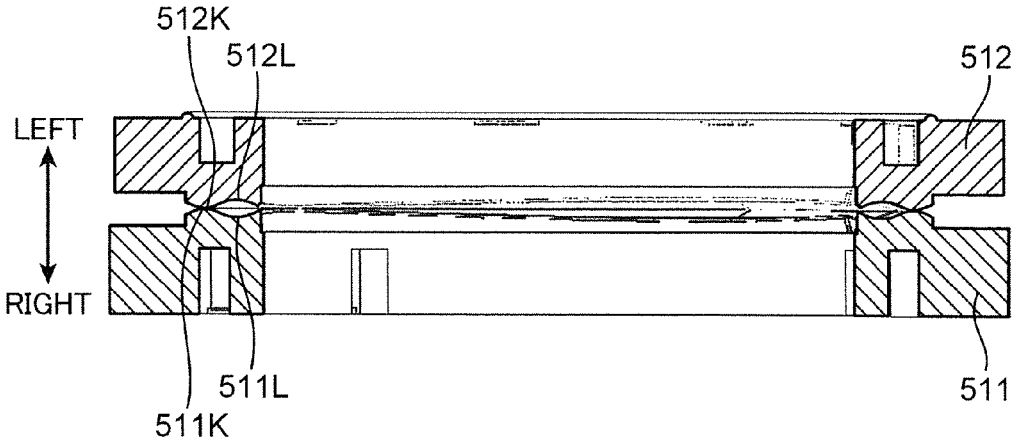
FIG. 15A is a cross-sectional view showing the state of the engagement between the first cam member and the second cam member according to the second embodiment of the present disclosure.
Figure 15B:
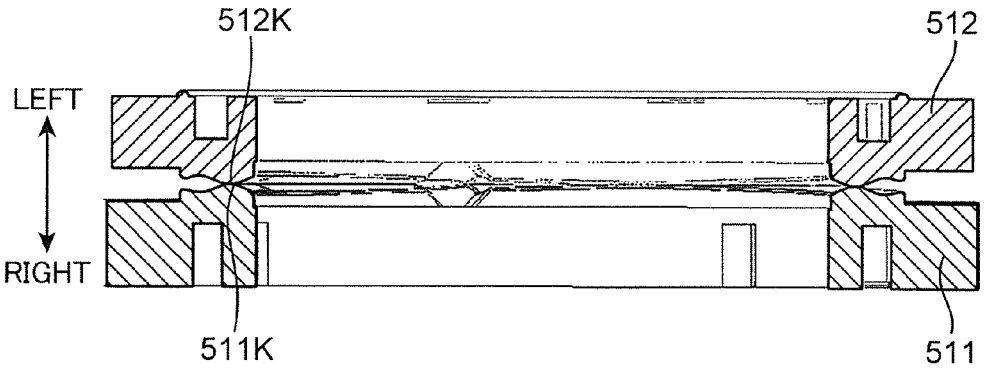
FIG. 15B is a cross-sectional view showing the state of the engagement between the first cam member and the second cam member according to the second embodiment of the present disclosure.

In addition, FIGS. 15A and 15B show states in which the drum driving gear 511 and the drum thrust gear 512 rotate by a predetermined angle from the states shown in FIGS. 14A and 14B. In FIGS. 15A and 15B, the first cam convex portions 511K are arranged to contact the second cam convex portions 512K, and the first cam concave portions 511L are arranged to face the second cam concave portions 512L. Thus, the photosensitive drum 51 is arranged at a position (first position) most separated from the drum thrust gear 512 in the axial direction. When the convex portions of the drum driving gear 511 and the drum thrust gear 512 contact each other, the falling of the drum driving gear 511 and the drum thrust gear 512 is likely to occur. However, in the embodiment, the drum driving gear 511 and the drum thrust gear 512 are kept in contact with each other even at different positions in the rotation direction (circumferential direction) as shown in FIGS. 15A and 15B. In other words, the convex portions of the drum driving gear 511 and the drum thrust gear 512 continuously contact each other along the rotation direction. Thus, compared with a case in which the convex portions are in point-contact with each other, the falling of the drum driving gear 511 and the drum thrust gear 512 is prevented.

As described above, in the embodiment, the cam portions of the drum driving gear 511 and the drum thrust gear 512 may continuously contact each other at all times along the rotation direction. Accordingly, the falling of the drum driving gear 511 and the drum thrust gear 512 is prevented, and sudden movement in the axial direction of the photosensitive drum 51 is prevented. As a result, an image shift due to the sudden movement of the photosensitive drum 51 is prevented. Note that since each of the image forming units 2Y, 2C, 2M, and 2Bk has the configuration of the drum unit 510 described above, an image shift in each of the colors is prevented. As a result, the color shift of an image finally formed on a sheet is prevented.

Note that the first cam convex portions 511K and the second cam concave portions 512L seem to have the same curvature and the second cam convex portions 512K and the first cam concave portions 511L seem to have the same curvature in FIGS. 13A and 13B. However, there is actually a slight difference between the curvatures of the first cam convex portions 511K and the second cam concave portions 512L and between the curvatures of the second cam convex portions 512K and the first cam concave portions 511L. That is, the curvature of the first cam convex portions 511K is set to be greater than that of the second cam concave portions 512L, and the curvature of the second cam convex portions 512K is set to be greater than that of the first cam concave portions 511L. Thus, the first cam convex portions 511K or the second cam convex portions 512K are prevented from fitting into the second cam concave portions 512L or the first cam concave portions 511L without a gap. As a result, the rotation of the drum driving gear 511 or the drum thrust gear 512 is not locally accelerated when the convex portions on one side fit into the concave portions on the other side, and an impact occurring when the convex portions fit into the concave portions is prevented from being transmitted to the photosensitive drum 51. In other words, compared with a case in which the first cam convex portions 511K and the second cam concave portions 512L have the same curvature, an impact occurring when the first cam convex portions 511K fit into the second cam concave portions 512L is reduced.

In addition, in the embodiment, the drum driving gear 511 has the first inner-side convex portions 511M, and the drum thrust gear 512 has the second inner-side convex portions 512M. Thus, when the first cam convex portions 511K fit into the second cam concave portions 512L, the first cam convex portions 511K are supported by the second cam convex portions 512K and the second inner-side convex portions 512M on both sides in the radial direction. In addition, when the second cam convex portions 512K fit into the first cam concave portions 511L, the second cam convex portions 512K are supported by the first cam convex portions 511K and the first inner-side convex portions 511M on both sides in the radial direction. Thus, the drum driving gear 511 and the drum thrust gear 512 reliably engage with each other, whereby the rotation and reciprocation of the photosensitive drum 51 are reliably carried out.

The second embodiment of the present disclosure is described above. The present disclosure is not limited to this, but the following modified embodiments may be applied.

(1) In the second embodiment, the two driving gear cam portions 511J and the two thrust gear cam portions 512J are arranged along the rotation direction. However, the present disclosure is not limited to this. A plurality of first cam convex portions 511K and a plurality of first cam concave portions 511L may be arranged at positions at which the drum driving gear 511 is evenly divided along the rotation direction. In addition, a plurality of second cam convex portions 512K and a plurality of second cam concave portions 512L may be arranged at positions, at which the drum thrust gear 512 is evenly divided along the rotation direction, to correspond in number to the first cam convex portions 511K and the first cam concave portions 511L, respectively. In this case, the number of the reciprocation times of the photosensitive drum 51 may be adjusted with the arrangement of the convex portions and the concave portions. On the other hand, a single driving gear cam portion 511J and a single thrust gear cam portion 512J may be arranged over the entire circumferential direction of the drum driving gear 511 and the drum thrust gear 512, respectively.

(2) In the second embodiment, the driving gear cam portions 511J and the thrust gear cam portions 512J are spirally formed to curve to the outside in the radial direction as they extend in the rotation direction of the drum driving gear 511 and the drum thrust gear 512. However, the present disclosure is not limited to this. The driving gear cam portions 511J and the thrust gear cam portions 512J may be spirally formed to curve to the inside in the radial direction as they extend in the rotation direction of the drum driving gear 511 and the drum thrust gear 512.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

a housing;

a photosensitive drum that is rotatably supported by the housing about a first shaft portion, an electrostatic latent image being formed on a peripheral surface of which, and a developer image being carried thereby;

a cleaning member that is supported by the housing, contacts the peripheral surface of the photosensitive drum, and cleans up the peripheral surface;

a driving transmission portion that transmits a rotation driving force about the first shaft portion to the photosensitive drum; and a movement mechanism that reciprocates the photosensitive drum in an axial direction of the first shaft portion at a predetermined cycle, a charging roller that has a third shaft portion parallel to the first shaft portion, rotates about the third shaft portion, contacts the peripheral surface of the photosensitive drum, and charges the peripheral surface; and a brush roller that has a fourth shaft portion parallel to the first shaft portion, rotates about the fourth shaft portion, and cleans up a surface of the charging roller, wherein the movement mechanism includes:

a first rotation gear that is fixed to the photosensitive drum and integrally rotates with the photosensitive drum about the first shaft portion;

a second rotation gear that is arranged facing the first rotation gear in the axial direction, has teeth different in number from teeth of the first rotation gear, is restricted in a position thereof in the axial direction, and rotates about the first shaft portion with a predetermined speed difference relative to the first rotation gear;

a first pair of rotation gears rotatable about a second shaft portion parallel to the first shaft portion of the photosensitive drum; and a second pair of rotation gears rotatable about the fourth shaft portion, the first pair of rotation gears including:

a first intermediate gear that engages with the first rotation gear and a second intermediate gear that is arranged adjacent to the first intermediate gear in the axial direction, engages with the second rotation gear, has teeth different in number from teeth of the first intermediate gear, and integrally rotates with the first intermediate gear, the second pair of rotation gears including:

a third rotation gear that engages with the first intermediate gear and integrally rotates with the brush roller and a fourth rotation gear that is arranged adjacent to the third rotation gear in the axial direction, has teeth different in number from teeth of the third rotation gear, engages with the second intermediate gear, is restricted in a position thereof in the axial direction, and rotates with a predetermined speed difference relative to the third rotation gear, the first rotation gear has a first cam surface that is arranged at a side surface thereof facing the second rotation gear and has different projection amounts in the axial direction along a circumferential direction thereof, the second rotation gear has a second cam surface that is arranged at a side surface thereof facing the first rotation gear, has different projection amounts in the axial direction along a circumferential direction thereof, and is capable of contacting the first cam surface, the third rotation gear has a third cam surface that is arranged at a side surface thereof facing the fourth rotation gear and has different projection amounts in the axial direction along a circumferential direction thereof, the fourth rotation gear has a fourth cam surface that is arranged at a side surface thereof facing the third rotation gear, has different projection amounts in the axial direction along a circumferential direction thereof, and is capable of contacting the third cam surface, the second rotation gear rotates with the speed difference relative to the first rotation gear as a result of the transmission of the rotation driving force from the first rotation gear to the second rotation gear via the first intermediate gear and the second intermediate gear when the photosensitive drum rotates with the rotation driving force, and the photosensitive drum reciprocates in the axial direction as a result of contact between the first cam surface and the second cam surface the brush roller rotates with transmission of the rotation driving force from the first intermediate gear to the third rotation gear and the fourth rotation gear rotates with the speed difference relative to the third rotation gear as a result of transmission of the rotation driving force from the second intermediate gear to the fourth rotation gear when the photosensitive drum rotates with the rotation driving force, and the brush roller reciprocates in the axial direction as a result of contact between the third cam surface and the fourth cam surface.

2. The image forming apparatus according to claim 1, wherein a plurality of the first cam surfaces are arranged at positions at which the first rotation gear is evenly divided along the circumferential direction, and a plurality of second cam surfaces corresponding in number to the first cam surfaces are arranged at positions, at which the second rotation gear is evenly divided along the circumferential direction.

3. The image forming apparatus according to claim 1, wherein the third shaft portion is arranged on a same axis line as an axis line of the second shaft portion.

4. The image forming apparatus according to claim 1, wherein the charging roller rotates following the rotation of the photosensitive drum, and a movement cycle of the photosensitive drum that reciprocates as a result of the contact between the first cam surface and the second cam surface differs from a movement cycle of the brush roller that reciprocates as a result of the contact between the third cam surface and the fourth cam surface.

5. An image forming apparatus comprising:

a housing;

a photosensitive drum that is rotatably supported by the housing about a shaft, an electrostatic latent image being formed on a peripheral surface thereof, and a developer image being carried thereby;

a cleaning member that is supported by the housing, contacts the peripheral surface of the photosensitive drum, and cleans up the peripheral surface; and a movement mechanism that reciprocates the photosensitive drum in an axial direction at a predetermined cycle, wherein the movement mechanism includes a first cam member that is fixed to the photosensitive drum and integrally rotates with the photosensitive drum about the shaft; and a second cam member that is arranged facing the first cam member in the axial direction, restricted in a position thereof in the axial direction, and rotates about the shaft with a predetermined speed difference relative to the first cam member, the first cam member includes:

a first convex portion that projects at a consistent height toward the second cam member in the axial direction and is curved spirally so that a radial position of the first convex portion differs at different positions on the first convex portion in a rotation direction of the first cam member, and a first concave portion that is arranged to be along the first convex portion and deeper in the axial direction than the first convex portion and spirally formed about the shaft, the second cam member includes:

a second convex portion that projects at a consistent height toward the first cam member in the axial direction and is curved spirally so that a radial position of the second convex portion differs at different positions on the second convex portion in the rotation direction of the second cam member, and a second concave portion that is arranged to be along the second convex portion and deeper in the axial direction than the second convex portion and spirally formed about the shaft, the photosensitive drum is positioned at a first position most separated from the second cam member when the first convex portion contacts the second convex portion as a result of the rotation of the first cam member and the second cam member about the shaft, and the photosensitive drum is positioned at a second position closest to the second cam member when the first convex portion fits into the second concave portion and the second convex portion fits into the first concave portion as a result of the rotation of the first cam member and the second cam member about the shaft.

6. The image forming apparatus according to claim 5, wherein a plurality of first convex portions and a plurality of first concave portions are arranged at positions at which the first cam member is evenly divided along the rotation direction, and a plurality of second convex portions and a plurality of second concave portions corresponding in number to the first convex portions and the first concave portions respectively are arranged at positions, at which the second cam member is evenly divided along the rotation direction.

7. The image forming apparatus according to claim 5, wherein each of the first convex portion of the first cam member and the second concave portion of the second cam member has an arc shape when seen in a cross section thereof crossing the rotation direction, and a curvature of the first convex portion is set to be greater than a curvature of the second concave portion.

8. The image forming apparatus according to claim 5, wherein the first cam member further includes a first auxiliary convex portion that is arranged to sandwich the first concave portion with the first convex portion in the radial direction and that is spirally formed about the shaft.

9. The image forming apparatus according to claim 8, wherein the second cam member further includes a second auxiliary convex portion that is arranged to sandwich the second concave portion with the second convex portion in the radial direction and that is spirally formed about the shaft.

10. The image forming apparatus according to claim 5, wherein each of the first cam member and the second cam member has gear teeth different in number from each other at an outer peripheral portion thereof, the image forming apparatus further including a pair of rotation gears rotatable about a shaft parallel to the shaft of the photosensitive drum, the pair of rotation gears including:

a third intermediate gear that engages with the gear teeth of the first cam member and a fourth intermediate gear that is arranged adjacent to the third intermediate gear in the axial direction, engages with the gear teeth of the second cam member, has teeth different in number from teeth of the third intermediate gear, and integrally rotates with the third intermediate gear and a driving transmission portion that transmits a rotation driving force about the shaft to the photosensitive drum, and the second cam member rotates with the speed difference relative to the first cam member as a result of transmission of the rotation driving force from the first cam member to the second cam member via the third intermediate gear and the fourth intermediate, gear when the photosensitive drum rotates with the rotation driving force.

* * * * *